US008336327B2

(12) United States Patent
Cole et al.

(10) Patent No.: US 8,336,327 B2
(45) Date of Patent: Dec. 25, 2012

(54) METHOD AND DEVICE FOR PRODUCING ICE HAVING A HARVEST-FACILITATING SHAPE

(75) Inventors: Ronald E. Cole, Greenwood, IN (US); Dennis D. Tremblay, Geneva, IL (US)

(73) Assignee: Nidec Motor Corporation, St. Louis, MO (US)

( * ) Notice: Subject to any disclaimer, the term of this patent is extended or adjusted under 35 U.S.C. 154(b) by 2187 days.

(21) Appl. No.: 10/895,570

(22) Filed: Jul. 21, 2004

(65) Prior Publication Data

US 2006/0016209 A1 Jan. 26, 2006

(51) Int. Cl.
*F25C 1/00* (2006.01)

(52) U.S. Cl. ..... 62/353; 62/344

(58) Field of Classification Search ..... 62/353, 62/344

See application file for complete search history.

(56) References Cited

U.S. PATENT DOCUMENTS

| | | | | |
|---|---|---|---|---|
| 2,109,822 | A | 3/1938 | Eddy | |
| 2,514,942 | A | 7/1950 | Eaton | |
| 2,756,567 | A | 7/1956 | Martin | |
| 3,027,731 | A | 4/1962 | Lindenberg et al. | |
| 3,029,609 | A | 4/1962 | Zearfoss, Jr. | |
| 3,075,364 | A * | 1/1963 | Kniffin | 62/353 |
| 3,299,656 | A | 1/1967 | Linstromberg et al. | |
| 3,396,552 | A | 8/1968 | Buchser | |
| 3,418,823 | A | 12/1968 | Vivai | |
| 3,433,030 | A | 3/1969 | Jacobs | |
| 3,620,497 | A | 11/1971 | Schaff | |
| 4,045,979 | A | 9/1977 | Mazzini | |
| 4,207,750 | A | 6/1980 | Simkins | |
| 4,429,550 | A | 2/1984 | Latter | |
| 4,487,024 | A | 12/1984 | Fletcher et al. | |
| 4,573,325 | A | 3/1986 | Chiu et al. | |
| 4,685,304 | A | 8/1987 | Essig | |
| 4,727,720 | A | 3/1988 | Wernicki | |
| 4,923,494 | A | 5/1990 | Karlovits | |
| 4,966,004 | A | 10/1990 | Midlang et al. | |
| 5,038,573 | A | 8/1991 | McAllister | |
| 5,129,237 | A | 7/1992 | Day et al. | |
| 5,182,916 | A | 2/1993 | Oike et al. | |
| 5,619,858 | A | 4/1997 | Gunderson et al. | |
| 5,675,975 | A * | 10/1997 | Lee | 62/72 |
| 5,889,243 | A * | 3/1999 | Edwards et al. | 200/35 R |
| 5,922,030 | A | 7/1999 | Shank et al. | |
| 6,067,806 | A | 5/2000 | Park | |
| 6,092,374 | A | 7/2000 | Kang et al. | |
| 6,357,720 | B1 | 3/2002 | Shapiro et al. | |
| 6,401,461 | B1 | 6/2002 | Harrison et al. | |

(Continued)

*Primary Examiner* — Frantz Jules
*Assistant Examiner* — Azim Abdur Rahim
(74) *Attorney, Agent, or Firm* — Maginot, Moore & Beck LLP

(57) ABSTRACT

An icemaker assembly includes an ice tray having at least one ice forming compartment. The ice forming compartment includes (i) a first planar lateral side surface, (ii) a second planar lateral side surface, and (iii) an arcuate bottom surface between the first lateral side surface and the second lateral side surface. The first planar surface and the second planar surface are positioned relative to each other so that (i) the first planar lateral side surface is spaced apart from the second planar lateral side surface at a downstream end of the ice forming compartment by a distance D1 relative to the ejection path of movement, (ii) the first planar lateral side surface is spaced apart from the second planar lateral side surface at an upstream end of the ice forming compartment by a distance D2 relative to the ejection path of movement, and (iii) D2 is greater than D1.

16 Claims, 18 Drawing Sheets

U.S. PATENT DOCUMENTS

| | | | |
|---|---|---|---|
| 6,513,337 | B1 | 2/2003 | Astvatsatrian et al. |
| 2001/0039802 | A1 | 11/2001 | Barrash |
| 2001/0039804 | A1 | 11/2001 | Newman et al. |
| 2003/0010053 | A1 | 1/2003 | Kim et al. |

* cited by examiner

METHOD AND DEVICE FOR PRODUCING ICE HAVING A HARVEST-FACILITATING SHAPE

CROSS REFERENCE

Cross reference is made to co-pending U.S. patent application Ser. No. 10/895,665, entitled Method and Device for Stirring Water During Icemaking and Ser. No. 10/895,792, entitled Method and Device for Eliminating Connecting Webs between Ice Cubes, which are assigned to the same assignee as the present invention, and which are filed concurrently herewith, the disclosure of which are hereby incorporated by reference in their entirety.

BACKGROUND AND SUMMARY

This invention relates to icemakers for household refrigerators and more particularly to icemakers producing harvest facilitating-shaped ice cubes.

As used herein the term ice cube shall have its commonly accepted meaning of a mass of ice formed in a mold and commonly used to ice drinks or foods. Thus, the term ice cube shall not be limited to cube-shaped or blocks of ice but shall include crescent-shaped, disk-shaped, tear drop-shaped, hemi-spherical and other similar shapes of ice. Typically automatic icemakers for household refrigerators produce crescent-shaped ice cubes.

In producing crescent-shaped ice cubes 180, a tray including a plurality of crescent-shaped compartments is provided. Near the top of each compartment, a slot or weir extends between each compartment and its adjacent compartment to allow water to flow between compartments as they are filled with water. Often a water inlet is in fluid flow communication with a single compartment so that water fills the compartment to the point of overflowing the slot or weir and the over flow water runs through the slot or weir into the adjacent compartment. As each compartment is filled and subsequently overfilled, water runs into adjacent compartments so that each compartment is filled. Typically each of the compartments has spaced apart substantially vertical side walls with a curved wall extending therebetween. The curved wall is often a nearly semi-cylindrical wall formed about an axis extending longitudinally above the ice tray. The side walls are substantially perpendicular to the axis but angle outwardly as they extend upwardly from the curved wall to facilitate forming of the tray using a molding process. Thus, crescent-shaped ice cubes 180 are formed having side walls 182, 184 that are closer together near the bottom 186 and farther apart near the top 188, as shown, for example, in FIG. 18. However, in the prior art, at any depth within the compartment, lines extending along the side walls are substantially parallel to each other. Thus, as shown, for example, in FIG. 19, the side walls 182, 184 at the top edge, and at any depth within the ice cube 180 formed in a prior art compartment, are substantially parallel to each other. Once all compartments are filled, the water is allowed to stand in the compartments until it freezes to form ice cubes 180.

Once frozen the ice cubes 180 are ejected from each compartment, typically by turning an ejector arm or rake. The ejector arm is typically mounted above the tray to rotate about the axis. Typically a separate finger for each compartment extends radially from the ejector arm. The finger has a length sufficient to permit the free end to extend into an associated compartment when the ejector arm is rotated to urge the ice cube therein out of the compartment. To facilitate ejection, a heater often runs for a period to induce the ice tray to thermally expand. This expansion permits the ice cube 180 to slide more freely from the tray under the inducement of the ejector arm. This expansion can reduce the torque exerted on the ejector arm.

In typical icemakers, the shapes of side walls of the compartments of the ice tray may not be formed in a perfectly parallel fashion or may become deformed over time so that a portion of the ice cube 180 exhibits a greater thickness than other portions of the ice cube 180. Thus, as the ejector arm pushes the ice cube 180 out of the tray, the thicker portion of the ice cube 180 may need to be forced through a thinner area of a compartment resulting in large torques on the ejector arm and the motor driving the ejector arm. Also, bulges (not shown) often form on the tops of the ice cubes 180 as a result of freezing from the outside inwardly which could create torque problems in ejecting the ice cube. Often, icemakers run the heater longer than necessary. Present art icemakers have to heat long enough for the compartment to widen and/or the ice crescent to melt sufficiently, for the wide end to slip through the narrow center.

It would be desirable to shape the ice formed in an icemaker to facilitate ejection of the ice with less torque and with less heater run time.

The icemaker disclosed herein produces an ice cube having an improved shape.

One embodiment of the disclosed icemaker includes a tray having an ice making compartment formed to produce a tapered crescent. The tapered crescent avoids thick sections of the ice crescent from having to traverse narrower sections of the tray compartment while being ejected. This reduces the ejection torque experienced by the motor and drive train driving the ejector arm. This also reduces the amount the temperature of the tray is required to be increased for ejection and reduces chips. Reduced heat and absence of chips reduces the tendency of the crescents to melt together in the harvest bucket, improves efficiency of the refrigerator's freezer compartment and allows for usage of a less expensive drive train and motor in the icemaker.

According to one aspect of the disclosure, an icemaker assembly includes and ice tray, an ice ejector and a motor having an output shaft coupled to the ice ejector. The ice tray has at least one ice forming compartment that defines a space. The ice ejector has at least one ejector member. Rotation of the output shaft of the motor causes the ejector member to advance into the space whereby ice located in the space is urged in an ejection path of movement out of the at least one ice forming compartment. The ice forming compartment includes (i) a first planar lateral side surface, (ii) a second planar lateral side surface, and (iii) an arcuate bottom surface interposed between the first lateral side surface and the second lateral side surface. The first planar lateral side surface and the second planar lateral side surface are positioned relative to each other so that (i) the first planar lateral side surface is spaced apart from the second planar lateral side surface at a downstream end of the ice forming compartment by a distance D1 relative to the ejection path of movement, (ii) the first planar lateral side surface is spaced apart from the second planar lateral side surface at an upstream end of the ice forming compartment by a distance D2 relative to the ejection path of movement, and (iii) D2 is greater than D1.

According to a second aspect of the disclosure, an icemaker assembly includes an ice tray and an ice ejector. The ice tray has at least one ice forming compartment that defines a space. The ice ejector has at least one ejector member configured to be received in the ice forming compartment. The ice forming compartment is defined by (i) a first partition member, (ii) a second partition member, and (iii) a floor. The space is (i) interposed between the first partition member and the second partition member, and (ii) positioned above the floor. The first partition member and the second partition member are positioned relative to each other so that (i) the first partition member is spaced apart from the second partition member at a rear side of the ice tray by a distance D1, (ii) the first partition member is spaced apart from the second partition member at a front side of the ice tray by a distance D2, and (iii) D2 is greater than D1.

According to yet another aspect of the disclosure, an icemaker assembly includes an ice tray, an ice ejector and a motor having an output shaft coupled to the ice ejector. The ice tray has at least one ice forming compartment that includes a first lateral side surface, a second lateral side surface, and a bottom surface which collectively defines a space. The ice ejector has at least one ejector member. Rotation of the output shaft of the motor causes the ejector member to advance into the space whereby ice located in the space is urged in an ejection path of movement out of the ice forming compartment. A distance defined between the first lateral side surface and the second lateral side surface asymptotically increases in relation to the ejection path of movement.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

Corresponding reference characters indicate corresponding parts throughout the several views. Like reference characters tend to indicate like parts throughout the several views.

DETAILED DESCRIPTION

Figure 1:
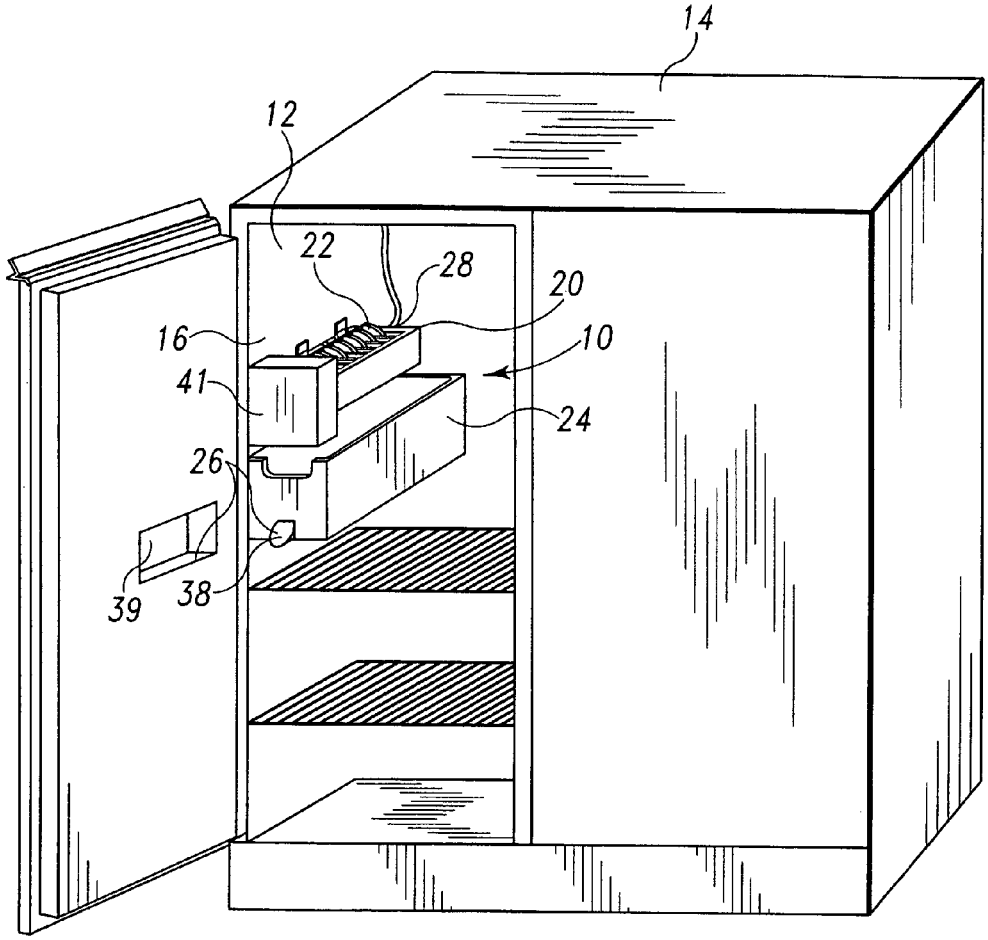
FIG. 1 is a perspective view of an icemaker mounted to the inside of a freezer compartment of a household side-by-side refrigerator/freezer showing an icemaker assembly including an ice tray, an ejector arm, and a control box wherein a motor is mounted, a water inlet, and an ice bin.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

As shown, for example, in FIG. 1, an icemaker assembly 10 is incorporated in a freezer compartment 12 of a household side-by-side refrigerator/freezer 14. The illustrated refrigerator/freezer 14 includes a through-the-door ice and water dispenser. To facilitate through-the-door delivery of ice, the illustrated icemaker assembly 10 includes an ice tray 20, an ice ejector 22, an ice bin 24, an ice dispenser 26, a water inlet 28, and a controller 30. In the illustrated icemaker assembly 10, the water inlet 28 is in fluid communication with ice tray 20 so that water is added to ice tray 20. Water received in the ice tray 20 freezes and is removed from the ice tray 20 by ejector 22. Ice ejected from the ice tray 20 is received in the ice bin 24 where it is stored awaiting use. The ice bin 24 is formed to include a dispenser 26 from which ice is dispensed to the user. In the illustrated embodiment of icemaker assembly 10, the dispenser 26 is a through-the-door ice dispenser. Thus, the ice bin 24 is configured to include a drive system of the dispenser 26 for driving ice from the bottom of the ice bin 24 to a dispenser opening 38 communicating with a chute 39 communicating with the through-the-door ice outlet.

Figure 2:
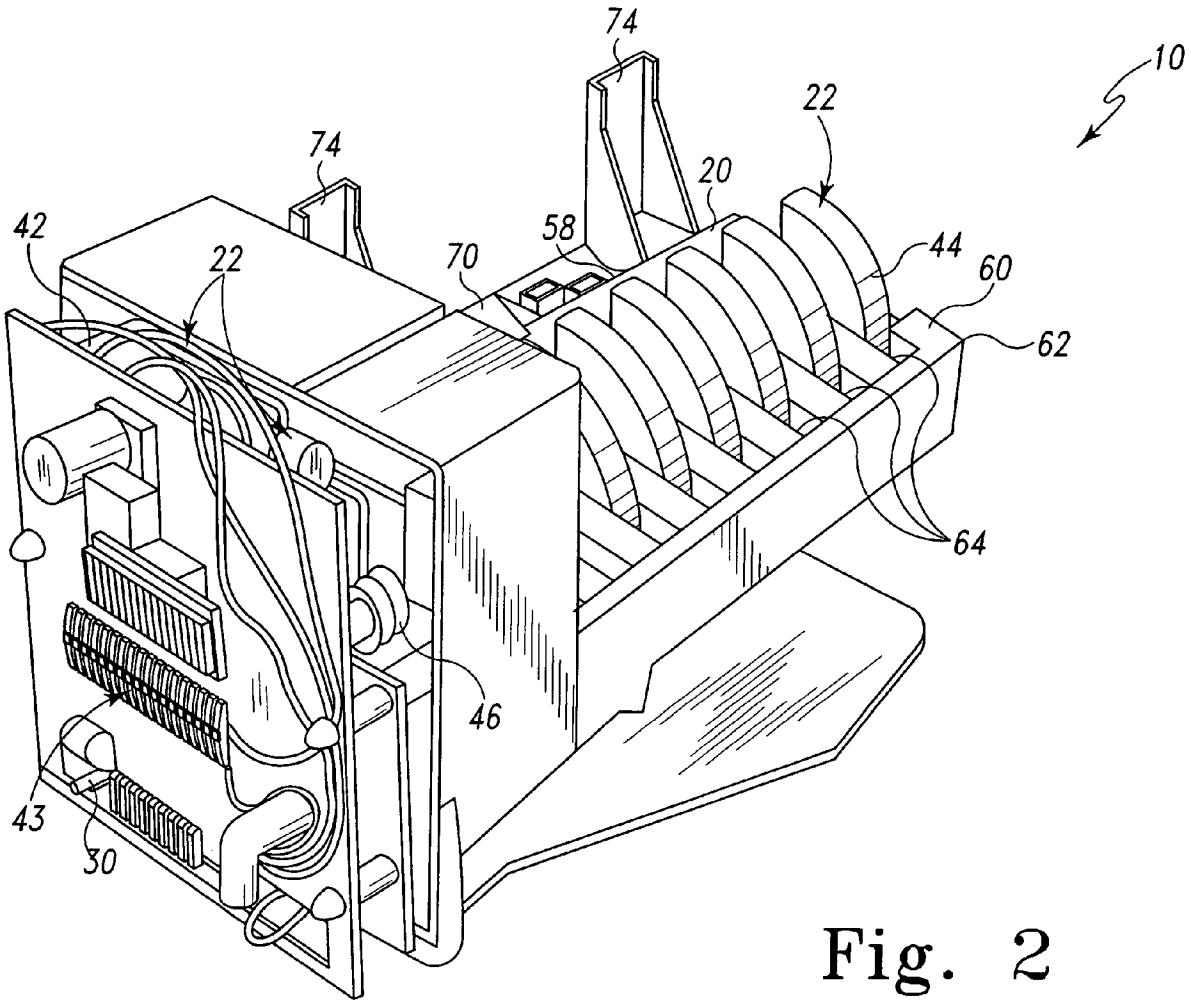
FIG. 2 is a perspective view of the icemaker assembly of FIG. 1 removed from the freezer compartment showing a cover removed from the control box to disclose a controller implemented in part on a PCB and a motor for rotating the ejector arm, the ejector members of which are shown partially inserted into compartments of the ice tray.
Figure 3:
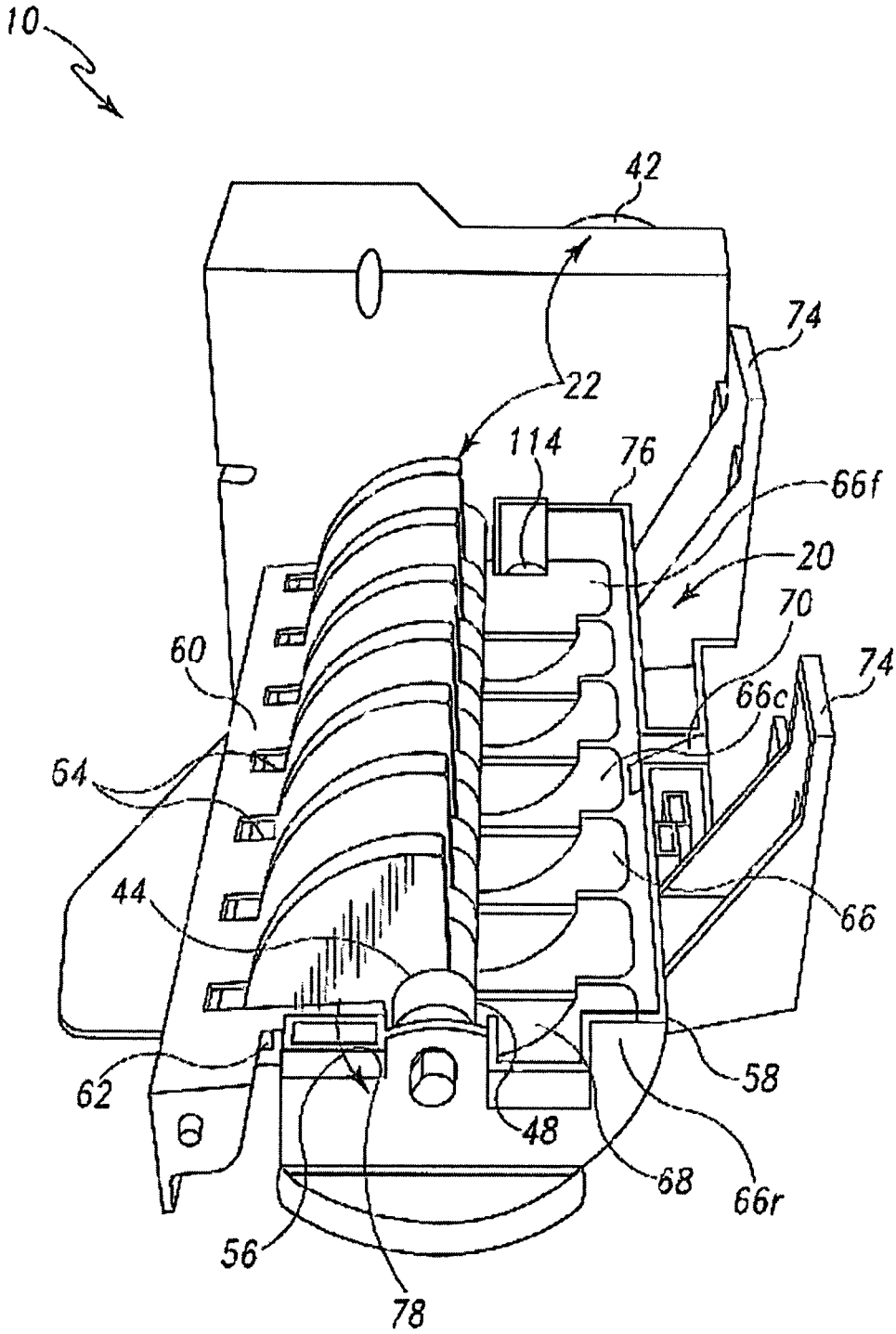
FIG. 3 a perspective view of the icemaker assembly of FIG. 2 showing the ejector arm and ice tray.
Figure 4:
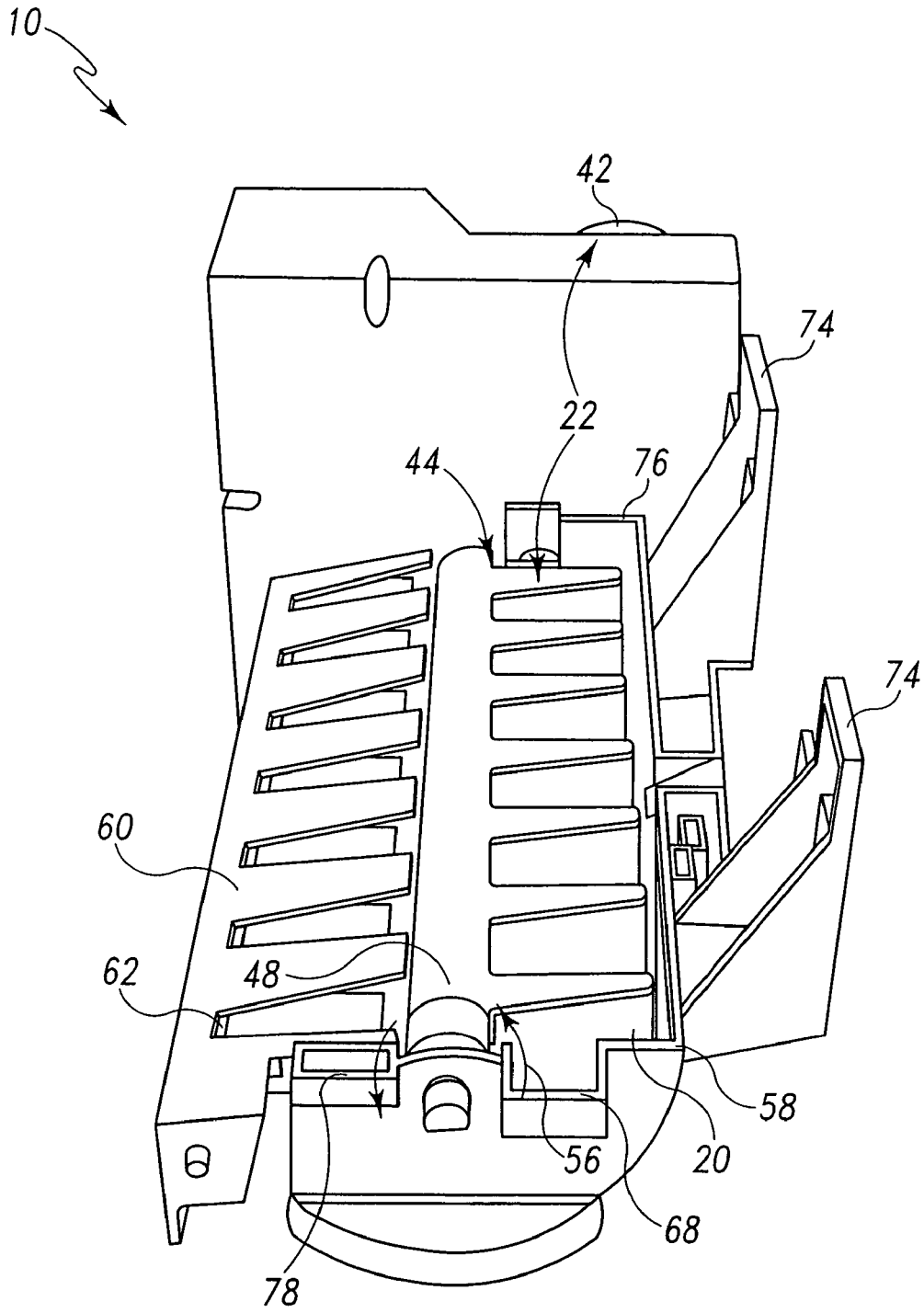
FIG. 4 is a perspective view of the ice tray and ejector arm of the icemaker in a first position wherein ejector members mounted to the shaft of the ejector arm are disposed within the ice forming compartments of the ice tray.
Figure 5:
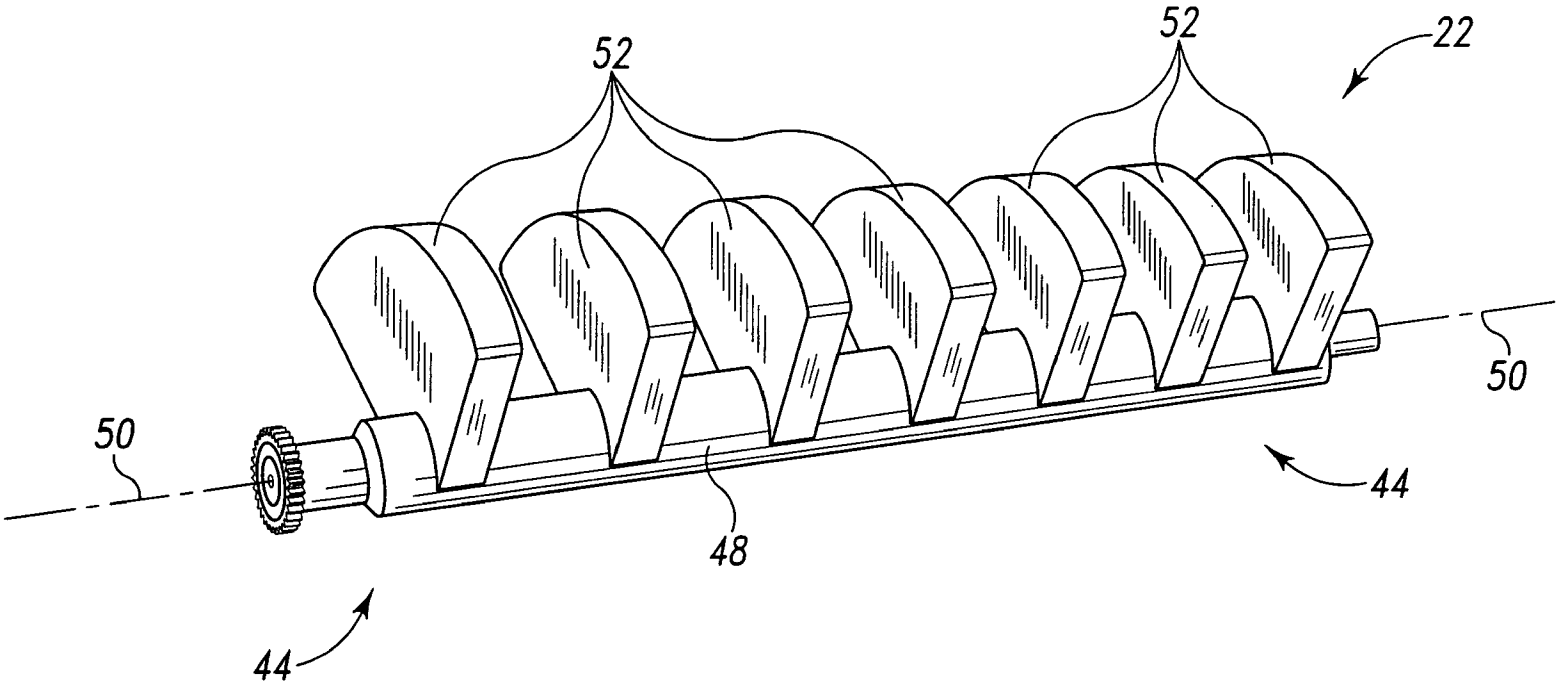
FIG. 5 is a perspective view of the ejector arm of the icemaker assembly of FIG. 2 showing seven ejector members mounted to a shaft configured to be rotated by the motor.
Figure 6:
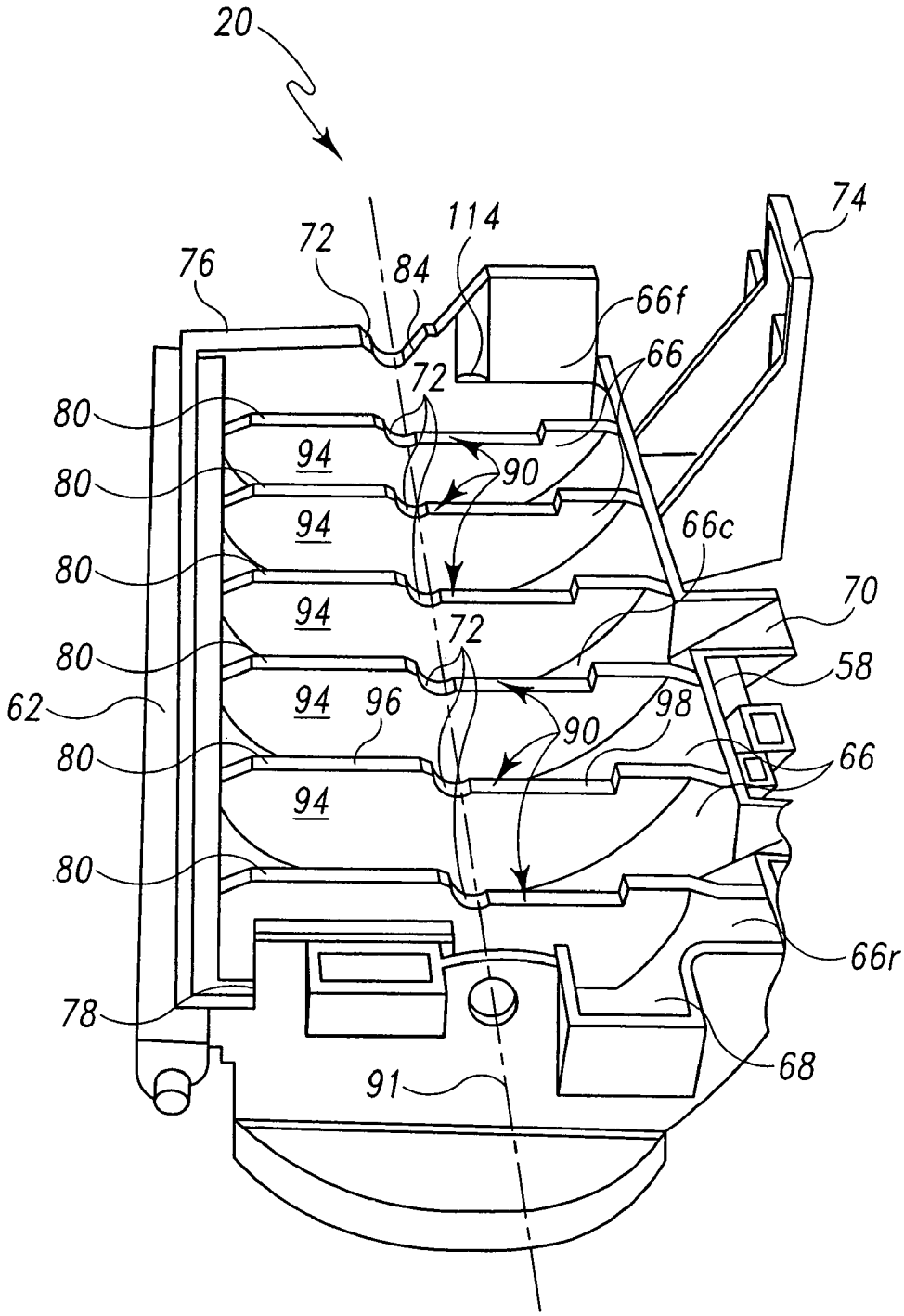
FIG. 6 is a perspective view of the ice tray of the icemaker assembly of FIG. 2 showing the overflow channels in divider walls between each adjacent tapered crescent-shaped compartment to facilitate overflow filling of the ice tray.

Referring now to FIGS. 2-9, the icemaker assembly 10 is shown removed from the freezer compartment 12 and in various states of disassembly. In FIG. 2, a cover 41 (FIG. 1) is removed from the icemaker assembly 10 to expose a circuit board 43 containing the controller 30. The ice ejector 22 includes a motor 42 having an output shaft, an ejector arm 44 and a drive train 46 coupling the output shaft of the motor 42 to the ejector arm 44. Ejector arm 44 includes a shaft 48 formed concentrically about a longitudinal axis 50 and a plurality of ejector members 52 connected to and extending radially beyond the shaft 48. In the illustrated embodiment, the ejector members 52 are crescent-shaped fins and are configured to extend from the shaft 48 into the ice tray 20 when the shaft 48 is rotated. It is within the scope of the disclosure for ejector members 52 to be fingers, shafts or other structures extending radially beyond the outer walls of shaft 48. Rotation of the output shaft of the motor 42 is transferred through the drive train 46 to induce rotation of the ejector arm 44 about its longitudinal axis 50.

Figure 9:
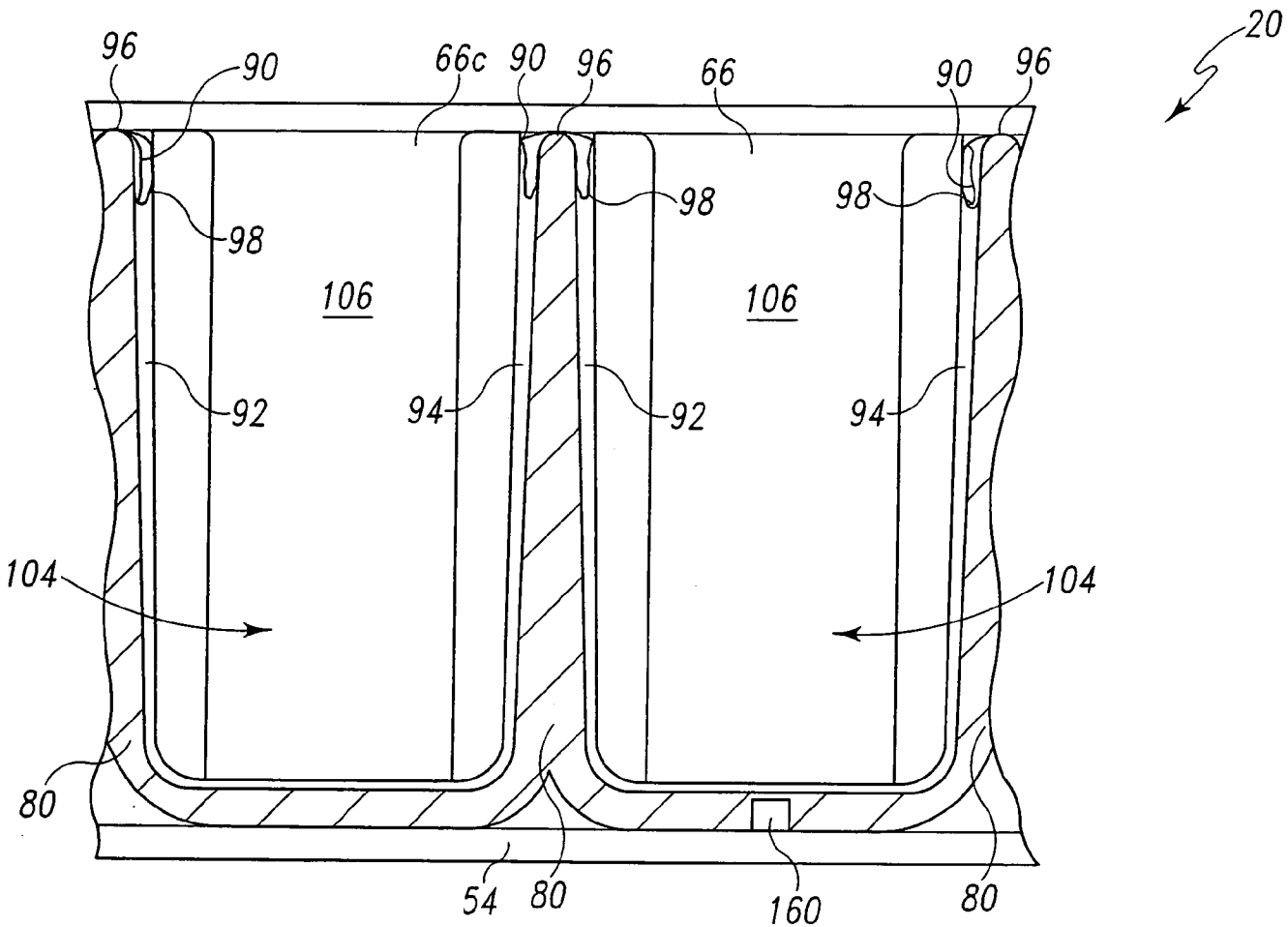
FIG. 9 is a sectional view of the ice tray taken along line 9-9 of FIG. 8 which also shows a heater disposed below the ice tray.
Figure 12:
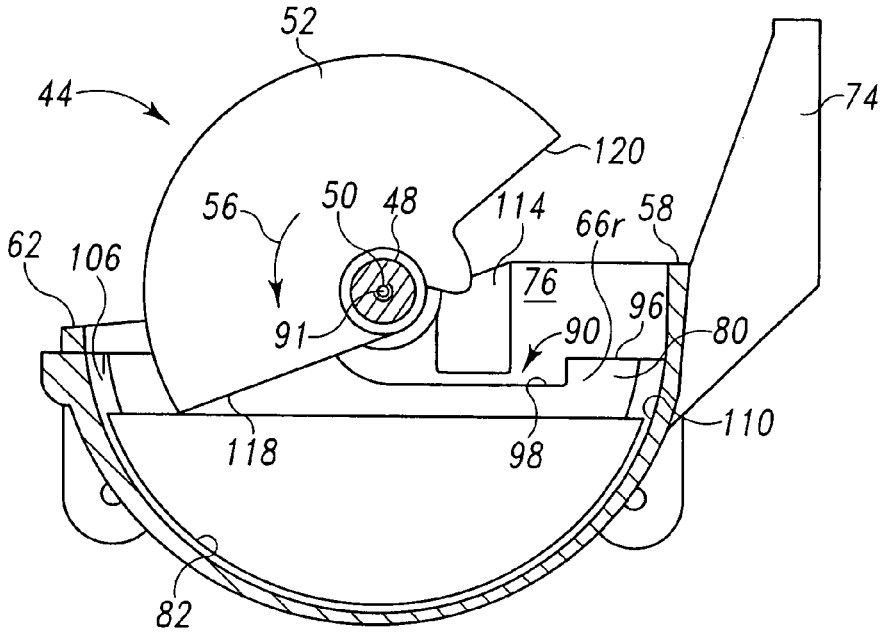
FIG. 12 is a sectional view similar to FIG. 11 after ice has formed in the compartment and the ejector arm has been rotated to bring the front face of the ejector member into contact with the top surface of the ice cube formed in the compartment.

Controller 30 includes sensors and a timer to control the motor 42 and ice tray heater 54, FIG. 9. Motor 42 is a reversible motor. Thus, controller 30 is configured to control the rotational movement of the motor by starting, stopping and reversing the direction of the motor. In one embodiment, motor 42 is a stepper motor. The controller 30 controls the motor 42 so that rotation of the ejector arm 44 is stopped for a period of time to permit water to freeze in the ice tray 20. Once the water is frozen in the ice tray 20, the controller 30 enables the motor 42 to drive the ejector arm 44 in the direction of arrow 56 in FIGS. 3, 4, 12 causing ice in the tray 20 to be forced out of the ejection side 58 of the tray 20. In the illustrated embodiment, ejection side 58 of the tray 20 is the side of the tray 20 adjacent the side wall 16 of the freezer compartment 12 to which the icemaker assembly 10 is mounted.

An ice guiding cover 60 extends inwardly from the outside 62 of the tray 20 and is configured to include slots 64 formed therein to permit the ejection members 52 of the ejector arm 44 to extend through slots 64 in the cover 60 into the ice tray 20. Ice cubes ejected from ejection side 58 of the tray 20 fall onto the cover 60 and slide off of the outer edge of the cover 60 into the ice bin 24.

As shown, for example, in FIGS. 6-9, ice tray 20 is formed to include seven tapered crescent-shaped compartments 66, an end water inlet ramp 68, a side water inlet ramp 70, ejector arm mounting features 72, and mounting brackets 74. Tray 20 includes a first end wall 76, a second end wall 78, a plurality of partitions or divider walls 80 and a plurality of floor walls 82 that cooperate to form the ice forming compartments 66. In the illustrated embodiment, as shown in FIG. 1, the end water inlet ramp 68 is formed in the second end wall 78 to be positioned below the water inlet 28 to facilitate filling the seven compartments 66 using the overflow method. The side water inlet ramp 70 is provided for those refrigerator/freezers 14 that position the water inlet along the mounting wall 16 of the freezer compartment 12. Those skilled in the art will recognize that additional inlet ramps may be formed in other locations in tray 20 within the scope of the disclosure. Illustratively, each ice forming compartment 66 is a tapered crescent-shape.

The ejector mounting arm features 72 include a shaft-receiving semi-cylindrical bearing surface 84 formed in the first end wall 76, a shaft-receiving semi-cylindrical bearing surface 86 formed in the second end wall 78, a shaft-receiving aperture 88 formed through the second end wall 78, and portions of each of a plurality of overflow channels 90 formed in each divider wall 80. The shaft-receiving semi-cylindrical bearing surfaces 84, 86 and the shaft-receiving aperture 88 are formed concentrically about the rotation axis 91 of the shaft 48 of the ejector arm 44. The shaft-receiving semi-cylindrical bearing surfaces 84, 86 the shaft-receiving aperture 88 and the portions of the overflow channels 90 are sized to receive the shaft 48 of the ejector arm 44 for free rotation therein. The shaft-receiving semi-cylindrical bearing surfaces 84, 86 the shaft-receiving aperture 88 and the portions of the overflow channels 90 are positioned to permit the longitudinal axis 50 of the shaft 48 of the ejector arm 44 to coincide with the rotation axis 91 when the ejector arm 44 is received in the tray 20 and rotated by the motor 42 and drive train 46.

In the illustrated embodiment, mounting brackets 74 extend from the ejection side 58 of the ice tray 20 to facilitate mounting the tray 20 to the mounting side wall 16 of the freezer compartment 12. It is within the scope of the disclosure for other mounting features to be present on the tray 20 and for those mounting features to facilitate mounting of the tray 20 to other structures within the freezer compartment 12.

As mentioned above, each partition or divider wall 80 extends laterally, relative to longitudinal axis 50, across the ice tray 20. In the illustrated embodiment, each divider wall 80 includes a forwardly facing lateral side surface 92, a rearwardly facing lateral side surface 94 and a top surface 96. The forwardly facing lateral side surface 92, rearwardly facing lateral side surface 94 and top surface 96 are formed to include an overflow channel 90. Each overflow channel includes a top wall 98 positioned below the top surface 96 of the divider wall 80. The top wall 98 of each overflow channel 90 is positioned near the desired maximum fill level of each compartment 66. The first end wall 76 includes a rearwardly facing lateral side surface 100. The second end wall 78 includes a forwardly facing lateral side surface 102.

In the illustrated embodiment, water from the water inlet 28 flows down the end water inlet ramp 68 into the rear ice forming compartment **66*r*. The water enters and fills the rear ice forming compartment 66*r* until the level reaches the level of the top wall 98 of the overflow channel 90 and then overflows into the compartment 66 adjacent the rear compartment 66*r*. After water fills each compartment 66 it overflows through the overflow channel 90 into the adjacent compartment 66. When the water in all of the compartments 66 has reached a desired level, water flow stops. This method of filling an ice tray 20** is often referred to as the overflow method.

The overflow method can also be used to fill all of the compartments 66 of the ice tray 20 when water first flows into the center compartment **66*c* into which the side water inlet ramp 70 flows when the water inlet is mounted to the mounting side wall 16 of the freezer compartment 12. When water first enters the tray 20 through the side water inlet ramp 70, the water overflows in both directions to fill each compartment 66 of the tray 20**.

Using the overflow method of filling an ice tray 20 often results in an ice bridge or web forming between the ice cubes, especially in the area of the over flow channel 90. Some prior art icemakers include much deeper channels or weirs to facilitate filling resulting in the formation of much thicker ice bridges. The presence of the ice bridge may increase the torque that the ejector arm 44 must exert to eject the ice cubes from the tray. Since it is desirable to reduce this torque, the present ice tray 20 seeks to minimize the size of the ice bridge by positioning the overflow channel 90 very near to the desired maximum fill level.

It is within the scope of the disclosure to position the overflow channel 90 above the maximum fill level to totally eliminate the ice bridge. One method of accomplishing elimination of the ice bridge while using the overflow fill method is to dispose an object in each compartment to displace water during filling and remove that object prior to freezing. A method of displacing water in the compartments during filling is disclosed in co-pending U.S. patent application Ser. No. 10/895,792, entitled Method and Device for Eliminating Connecting Webs between Ice Cubes, which is assigned to the same assignee as the present invention, the disclosure of which is hereby incorporated by reference in their entirety. While it is desirable to reduce or eliminate the ice bridge, it is within the scope of the disclosure to use a tray permitting a substantial ice bridge to form.

As shown, for example, in FIGS. 7-15, the compartments 66 in ice tray 20 are configured to include a space 104 in which a tapered crescent-shaped ice cube 130 is formed. In the illustrated embodiment first end wall 76 includes a planar lateral side surface 100 and second end wall 78 includes a planar lateral side surface 102. Each partition member or divider wall 80 includes a top surface 96 and two downwardly extending oppositely facing lateral side surfaces 92, 94. The forwardly facing planar lateral side surface 102 of the second end wall 78, the rearwardly facing planar lateral side surface 94 of the divider wall 80 adjacent the second end wall 78 and the arcuate bottom surface or floor wall 82 cooperate to define a space 104 in the rear compartment 66*r* in which ice is formed. Similarly, the rearwardly facing planar lateral side surface 100 of the first end wall 76, the forwardly facing planar lateral side surface 92 of the divider wall 80 adjacent the first end wall 76 and the arcuate bottom surface 82 cooperate to define a space 104 in the front compartment 66*f* in which ice is formed. The spaces 104 in which ice is formed in the intermediate compartments 66 are defined by the rearwardly facing planar lateral side surface 94 of a divider wall 80, the forwardly facing planar lateral side surface 92 of the adjacent divider wall 80 to the rear of the first divider wall 80 and the arcuate bottom surface 82. Thus the ice forming space 104 in each compartment 66 includes a first planar lateral side surface 100 or 94, a second planar lateral side surface 102 or 92, and an arcuate bottom surface 82 interposed between the first lateral side surface 100 or 94 and the second lateral side surface 102 or 92.

Figure 7:
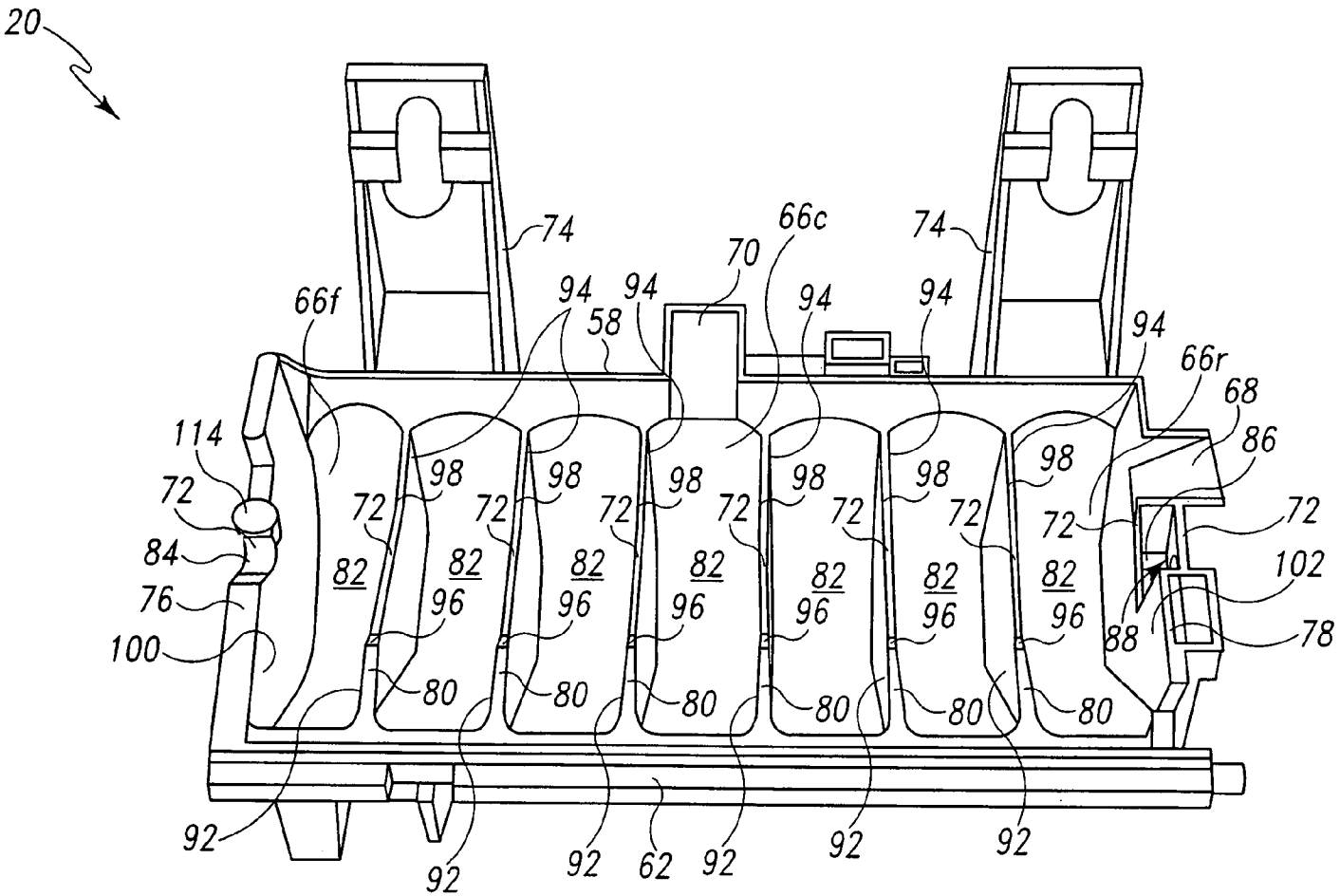
FIG. 7 is a perspective view of the ice tray of FIG. 6 showing the tapered crescent-shaped compartments.
Figure 8:
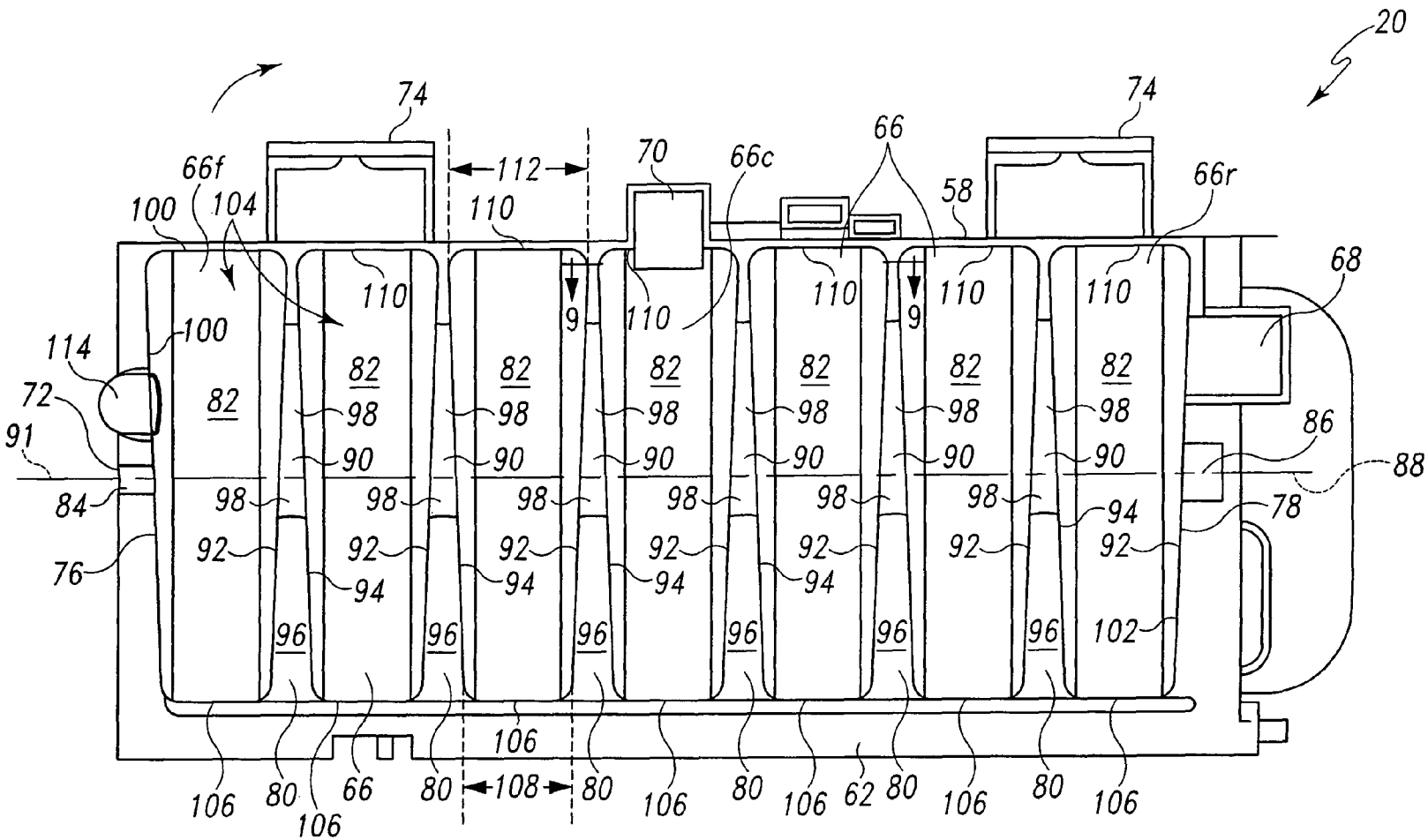
FIG. 8 is a plan view of the ice tray of FIG. 7 showing the configuration of the divider walls between adjacent tapered crescent-shaped compartments.

As shown, for example, in FIGS. 7-9, each compartment 66 is substantially identical. In each compartment 66, one planar lateral side surface 100, 94, from an end wall 76 or a divider wall 80, respectively, is positioned relative to a second planar lateral side surface 92, 102, from an adjacent divider wall 80 or end wall 78, respectively, so that the first planar lateral side surface 100, 94 is spaced apart from the second planar lateral side surface 92, 102 at a downstream end 106 by a distance D1 108 relative to an ejection path of movement. As mentioned previously, the ejection path of movement in the illustrated ice tray 20 is laterally across the ice tray 20 from the outside 62 of the ice tray 20 to the ejection side 58 of the ice tray 20. Thus, as used herein, the downstream end 106 for ice tray 20 is adjacent the outside 62 of the tray 20. Therefore, adjacent the outside 62 of the tray 20, the first planar lateral side wall 100, 94 of each compartment 66 is spaced apart from the second planar lateral side surface 92, 102 by the distance D1 108.

In each compartment 66, the first planar lateral side surface 100, 94 is spaced apart from the second planar lateral side surface 92, 102 at an upstream end 110 of the compartment 66 by a distance D2 112 relative to the ejection path of movement. In the illustrated embodiment, the upstream end 110 of the compartment 66 is the end of the compartment 66 adjacent the ejection side 58 of the tray 20. As shown, for example, in FIG. 8, the distance D2 112 is greater than the distance D1 108.

In the illustrated embodiment, each lateral side surface 92, 94, 100, 102 is planar, except for a bottom portion that smoothly curves into the bottom surface 82 to facilitate formation of the ice tray 20 using a molding process. As in prior art ice trays, the width of the compartment 66 may be narrower near the bottom and wider near the top, as shown, for example, in FIG. 9, to facilitate formation of the ice tray 20 using a molding process. Thus, in describing a distance between lateral side walls of a compartment 66, the distance is measured at the same level within the compartment. As the side surface 92, 94, 100, 102 extends laterally across the ice tray 20 from the outside 62 of the ice tray 20 to the ejection side 58 of the ice tray 20, the distance between each lateral side surface 100, 94 and the oppositely facing lateral side surface 92, 102 of the compartment 66 increases. In the illustrated embodiment, this increase in distance between oppositely facing lateral side surfaces 92, 102 and 100, 94, respectively, in each compartment 66 is asymptotic.

Figure 16:
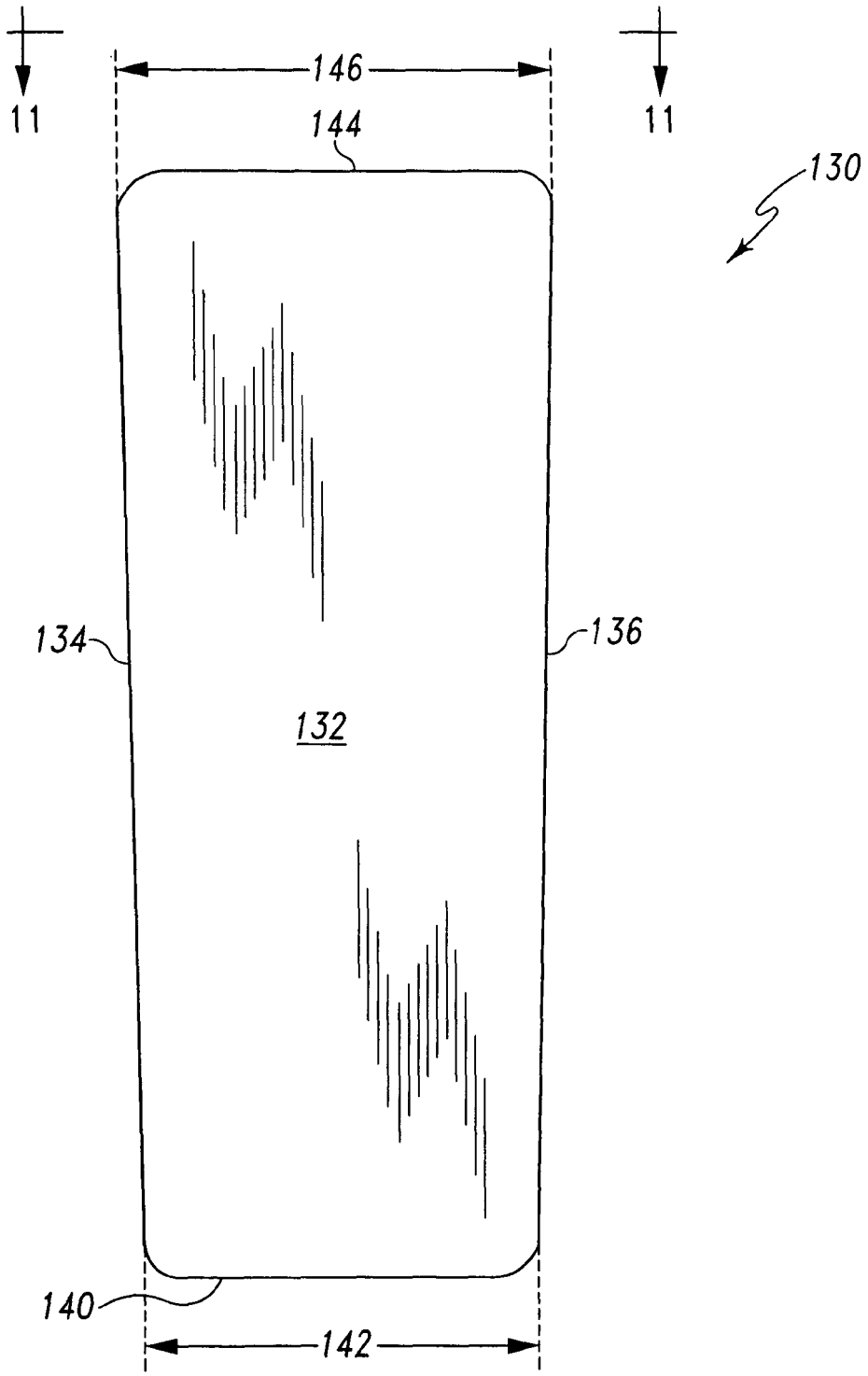
FIG. 16 is a plan view of a tapered crescent-shaped ice cube formed in the tray of FIG. 8.
Figure 17:
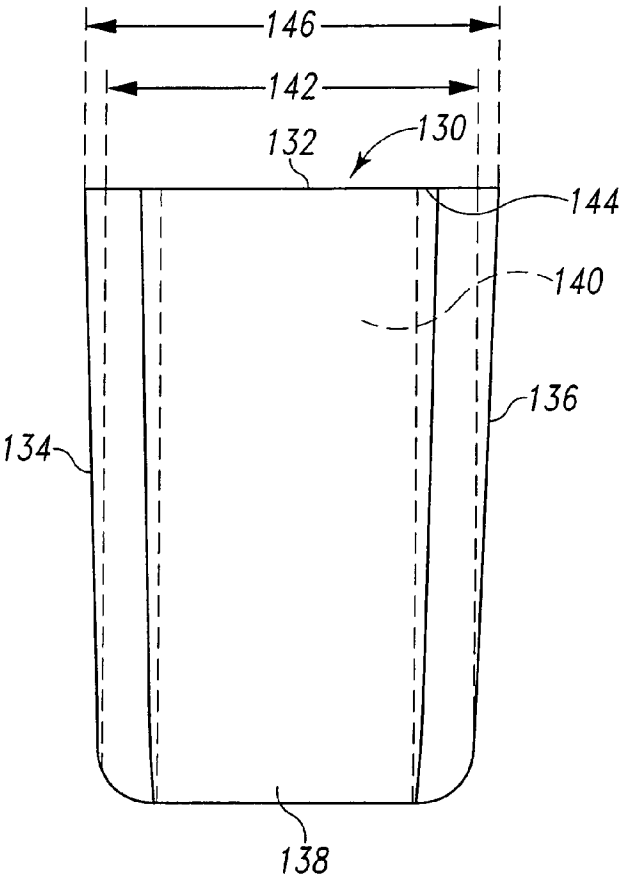
FIG. 17 is an elevation view taken along line 17-17 of FIG. 16 of the tapered crescent-shaped ice cube.
Figure 18:
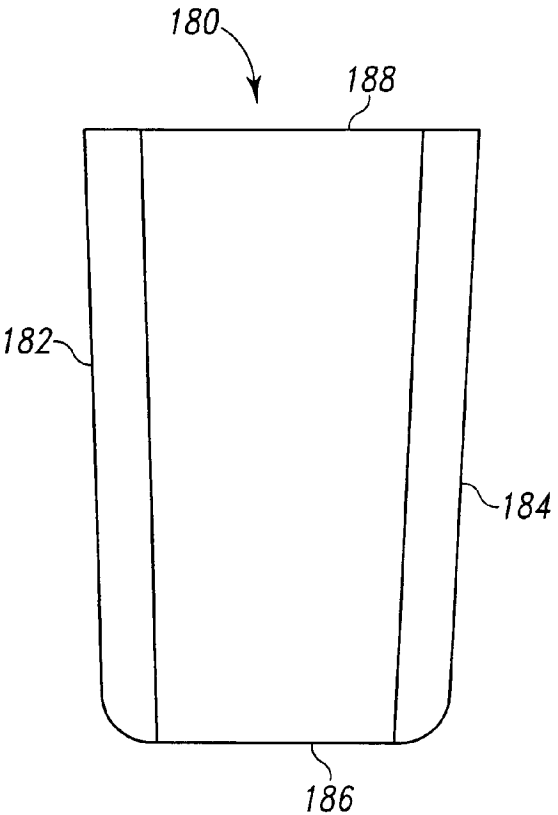
FIG. 18 is an elevation view of a prior art crescent-shaped ice cube.
Figure 19:
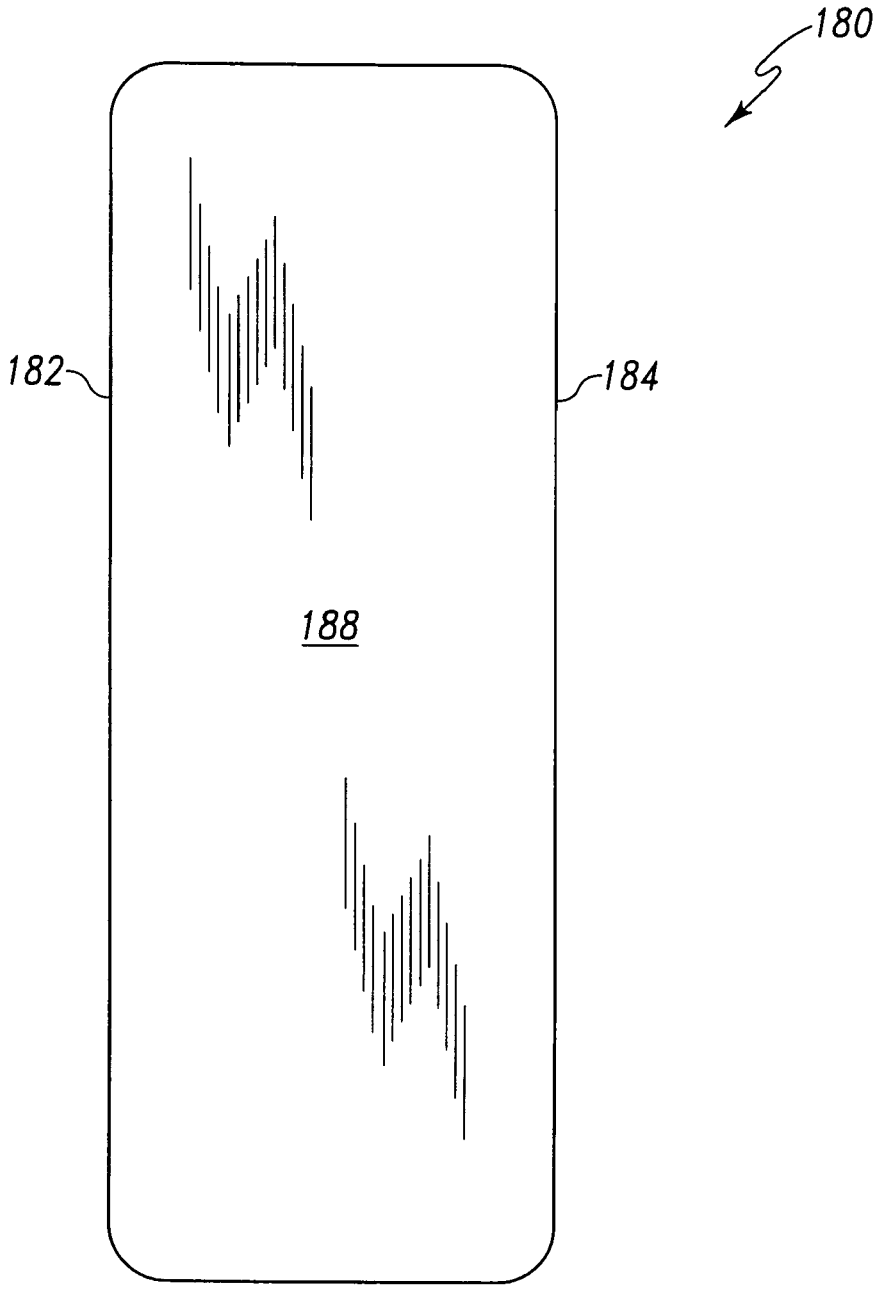
FIG. 19 is a plan view of a prior art crescent-shaped ice cube.

As shown, for example, in FIGS. 16 and 17, an ice cube 130 formed in a space 104 in an illustrated compartment 66 of the ice tray 20 has an external shape conforming on three surfaces to the lateral side surfaces 92, 102 and 100, 94, respectively, and bottom surface 82 of the compartment 66. On the top surface 132, the ice cube 130 is substantially flat. The top surface 132 may include an upwardly extending central bulge (not shown) formed as a result of the ice forming process. A method to eliminate this central bulge is described in U.S. patent application Ser. No. 10/895,665, entitled Method and Device for Stirring Water During Icemaking, which is assigned to the same assignee as the present invention, the disclosure of which is hereby incorporated by reference in its entirety.

The ice cube 130 includes a first lateral side wall 134 and oppositely facing second lateral side wall 136 and an arcuate shaped bottom wall 138 extending between the first and second lateral side walls 134, 136, respectively. The ice cube 130 has a narrow end 140 having a width 142 substantially equal to the distance D1 108 and a wide end 144 having a width 146 substantially equal to the distance D2 112.

Except where they merge with bottom wall 138, side walls 134, 136 are substantially planar as a result of the ice conforming to the shape of the lateral side surfaces 100, 94 and 92, 102 of the compartment 66. The distance between lateral side walls 134, 136 at any level of the cube 130 increases slightly from bottom to top as a result of conforming to the lateral side surfaces 100, 94 and 92, 102 of the ice forming compartment 66 which are configured to facilitate formation of the ice tray 20 using a molding process. The distance between lateral side walls 134, 136 of the ice cube 130 at any given level increases asymptotically from the narrow end 140 to the wide end 144.

Although described and illustrated as being planar, it is within the scope of the disclosure for lateral side surfaces 100, 94 and 92, 102 of the compartment 66 to have other configurations such as being arcuate shaped. However, to avoid having the ice cube 130 formed in the tray 20 from having wider sections that must be forced through narrower sections of the compartment 66 during ejection, the distance between oppositely facing lateral side surfaces 100, 94 and 92, 102 should increase from the outside 62 to the ejection side 58 of the tray 20. Preferably, the distance between oppositely facing lateral side surfaces 100, 94 and 92, 102 of a compartment 66 increases asymptotically in relation to the ejection path of movement.

While described and illustrated as having the same configuration, it is within the scope of the disclosure for compartments 66 of the ice tray 20 to have differing configurations. For example, it is within the scope of the disclosure for one compartment 66 to include a planar lateral side surface, an oppositely facing arcuate lateral side surface and an arcuate bottom surface while another compartment 66 includes two oppositely facing planar lateral side surfaces and a sloped bottom surface. Various combinations of lateral side surface and bottom surfaces may be used to define a compartment 66.

In use, water is released from the water inlet 28 and flows down the end water inlet ramp 68 into the rear compartment **66*r*. As shown, for example, in FIG. 10, when sufficient water has entered the rear compartment 66*r* to raise the level of the water in the compartment 66*r* to the level of the top surface 98 of the overflow channel 90, water overflows into the adjacent compartment 66 until the adjacent compartment 66 overflows into its adjacent compartment 66. This fill and overflow process continues until water has filled each compartment 66. The water filling operation may be based on a set time that is calibrated to ensure proper filling of all of the compartments 66 of the tray 20 or the level of the water in the last compartment 66*f*** to be filled may be sensed.

In the illustrated embodiment, a fill level reservoir 114 is formed in the first end wall 76 of the front compartment **66*f*. Water flows into the fill level reservoir 114 when each compartment 66 is filled to the desired level. A sensor (not shown) in the fill level reservoir 114 senses the presence of water and sends a signal to the controller 30 to stop the filling operation. Cessation of the filling operation may be accomplished in various ways, however, the illustrated icemaker assembly 10 closes a solenoid valve (not shown) positioned between the water source (not shown) and the water inlet 28** to stop the filling operation.

Figure 10:
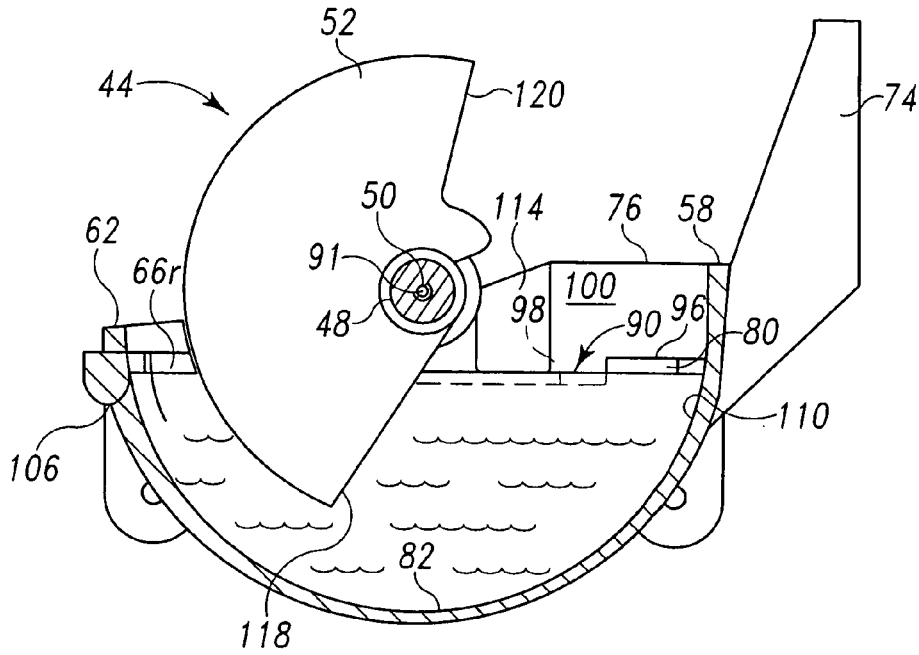
FIG. 10 is a sectional view of the ice tray and ejector arm taken through the rear compartment adjacent the rear end wall looking toward the front end wall during the fill operation showing an ejector member extending into the ice forming space of the compartment to displace water that is flowing over the overflow channel.

In the illustrated embodiment, following the previous ice ejection operation, the ejection arm 44 is rotated so that a portion of the ejection member 52 adjacent the front face 118 of the ejection member 52 is disposed in each compartment 66, as shown, for example, in FIG. 10. This portion of the ejection member 52 displaces water in the compartment 66 inducing overflow of the water prior to there being a sufficient volume of water to alone cause overflow of the compartment 66. Once the sensor in fill level reservoir 114 senses the presence of water, the flow of water into the ice tray 20 is stopped. At some time prior to the water freezing in each compartment 66, the ejector arm 44 is turned in the direction of arrow 116 in FIG. 11 until the entire ejection member 52 is disposed outside of the ice forming space 104 in each compartment 66, as shown, for example, in FIG. 11. It is within the scope of the disclosure for the rotation of the ejector arm 44 to be stopped following ejection of the ice cubes 130 from the compartments 66 so that a portion of the ejector member 52 adjacent the rear face 120 of the ejector member 52 is left disposed in the ice forming space of each compartment 66 to displace water during the next filling operation.

Figure 11:
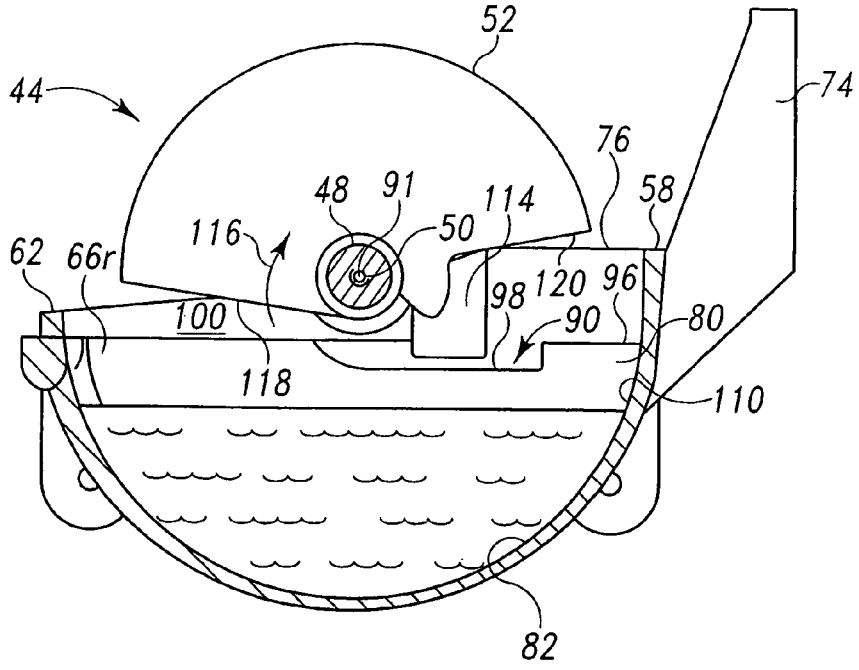
FIG. 11 is a sectional view similar to FIG. 10 following removal of the ejector member from the ice forming space of the compartment and prior to ice forming in the compartment showing how the water level falls below the level of the overflow channel to eliminate formation of an ice bridge between adjacent cubes.

After removal of the ejection member 52 from each compartment 66, the level of water in each compartment 66 lowers to below the level of the top surface 98 of the overflow channel 90, as shown, for example, in FIG. 11. Thus each cube 130 is formed separately within its own compartment 66 with no ice bridge or web extending between cubes 130. The size of the ice cube 130 formed in each compartment 66 can be varied by varying the volume of the portion of the ejector member 52 disposed in the ice forming space 104 during the filling operation. This method of filling an ice cube tray is more particularly described in co-pending U.S. patent application Ser. No. 10/895,792, entitled Method and Device for Eliminating Connecting Webs between Ice Cubes.

In the illustrated embodiment, once an ice cube 130 has formed in each compartment 66, the controller 30 actuates the heater 54 which heats the tray 20 to expand the tray 20 and possibly melt a small amount of ice cube 130 adjacent the walls of each compartment 66. The melting of the cube 130 provides a lubrication layer between the ice cube 130 and the walls of the compartment 66, which along with the thermal expansion reduces the torque which the ejector arm 44 must exert on the ice cube 130 to induce the cube 130 to move along the ejection path of movement and be ejected from the ice tray 20. The innovative design of the walls of the compartments 66 of the ice tray 20 further reduces the torque required for the ejector 22 to eject the ice cubes 130 from the ice tray 20. Thus, the temperature rise required in the heating step may be reduced or even eliminated.

The innovative design of the compartments 66 of the ice cube tray 20 facilitates shorter heating cycles or even the elimination of the heating cycle. The design also facilitates a reduction of the power consumption of the heater or the elimination of the heater. Any reduction in the heating cycle also increases the efficiency of the freezer compartment 12 as less heat is required to be dissipated following each ice cube ejection cycle. Additionally, since wider sections of an ice cube 130 are not forced through narrower sections of a compartment 66, the ice cube 130 is less likely to chip than a conventional ice cube 180 during ejection. The reduction or elimination of chips, in combination with the reduction in the heating cycle, makes it less likely that ice cubes 130 will fuse together in the ice bin 24.

Once the ice cubes 130 are ready for ejection, the controller 30 actuates the motor 42 to turn its output shaft which is coupled through the drive train 46 to the ejector shaft 48. The motor 42 drives the ejector shaft 48 to rotate about the rotation axis 91 in the direction of arrow 56 inducing the front face 118 of each ejection member 52 to pass through its associated slot 64 in the ice guiding cover 60 and into contact with the ice cube 130 formed in its associated compartment 66, as shown, for example, in FIGS. 12 and 14. The front face 118 of each ejector member 52 contacts the top surface 132 of its associated ice cube 130 adjacent the narrow end 140 of the cube 130 and exerts a force driving the narrow end 140 of the cube 130 downwardly along the arcuate bottom surface 82 of the compartment 66.

Figure 13:
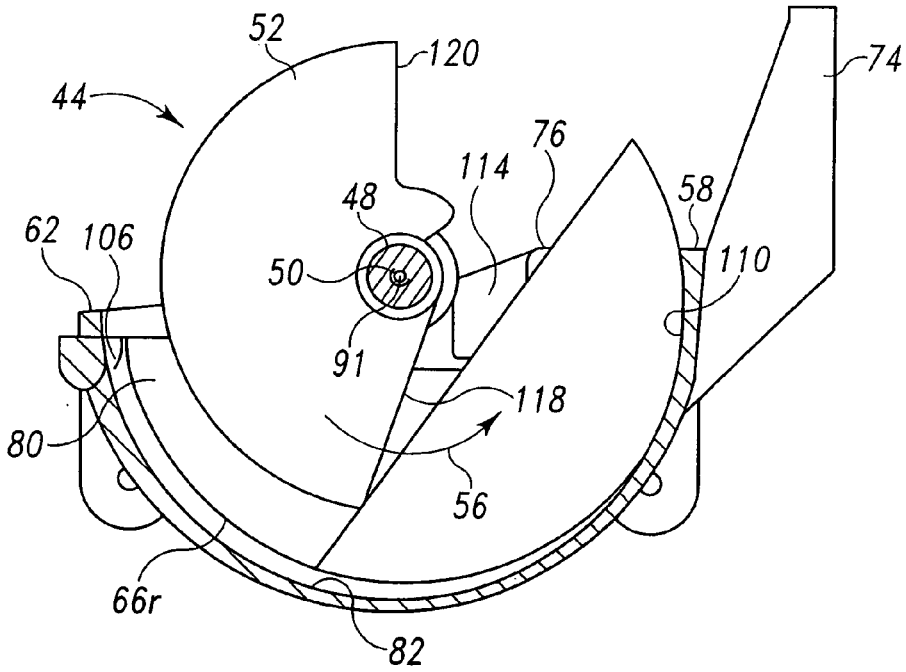
FIG. 13 is a sectional view similar to FIG. 12 after the ejector arm has rotated partially into the ice forming space to urge the ice cube formed in the compartment along an ejection path of motion.
Figure 15:
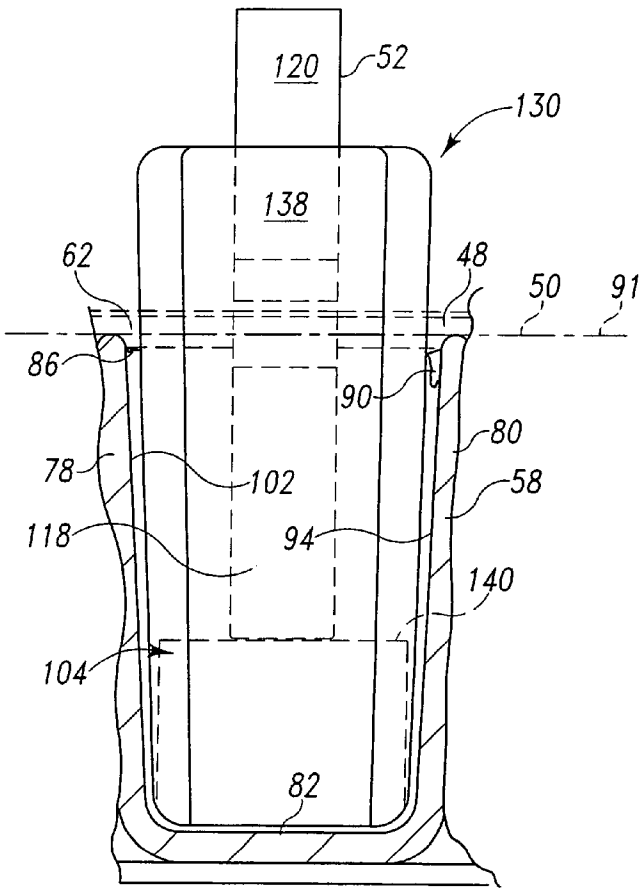
FIG. 15 is a sectional view similar to FIG. 14 showing the ice cube and ejector arm in the position shown in FIG. 13.
Figure 14:
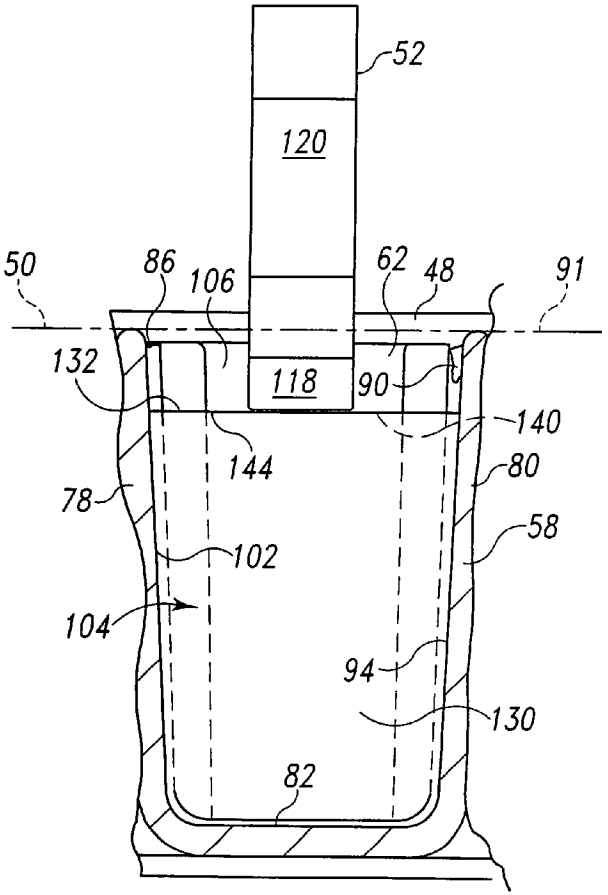
FIG. 14 is a sectional view taken adjacent the ejector side of the tray through the rear compartment looking toward the outside showing the ejector arm and ice cube formed in the rear compartment in the position shown in FIG. 12.

As the narrow end 140 of the ice cube 130 is driven downwardly along the arcuate bottom surface 82 of the compartment 66, the rigidity of the ice cube 130, the bottom wall 138 of the ice cube 130 and the arcuate bottom surface 82 of the compartment 66 cooperate to urge the wide end 144 of the ice cube 130 to move upwardly along the bottom surface 82 of the compartment 66 on the ejection side 58 of the tray 20, as shown, for example, in FIGS. 13 and 15. As the ejector arm 44 continues to rotate in the direction of arrow 56, the front surface 118 of the ejector member 52 follows the ejection path of movement laterally through the compartment 66 inducing more and more of the ice cube 130 to be ejected from the compartment 66 on the ejection side 58.

Since the distance between the lateral side walls 100, 94 and 92, 102 of the compartment 66 increases relative to the ejection path of movement, thinner portions of the ice cube 130 are forced through wider portions of the compartment 66 during ejection, as shown, for example, in FIG. 15. Since narrower side walls 134, 136 of the ice cube 130 are passing through wider walls 100, 94 and 92, 102 of the compartment, friction between the ice cube 130 and the lateral walls 100, 94 and 92, 102 of the compartment 66 is substantially reduced or eliminated. The reduction of friction between the side walls 134, 136 of the ice cube 130 and the lateral walls 100, 94 and 92, 102 of the compartment 66 results in less torque being exerted on the motor 42 and drive train 46 than during ejection of a prior ice cube 180 from a prior art tray. Thus, a less robust motor 40, drive train 46 and ejector arm 44 may be utilized to eject the ice cubes 130 from the disclosed tray 20.

As the narrow end 140 of the ice cube 130 approaches the ejection side 58 of the tray 20, the wider end 144 begins to move laterally toward the outside 62 of the tray 20. Eventually, the ice cube 130 falls outwardly and downwardly onto the ice guiding cover 60 which is sloped to induce the ice cubes 130 to slide along the cover 60 and fall off of the outside edge of the cover 60 and into the ice bin 24 located below the ice tray 20.

Once the ejector arm 44 has proceeded along the ejection path of movement a sufficient distance to completely eject the ice cubes 130 from each compartment 66, the ejection member 52 is positioned so that a portion of the ejection member 52 is disposed in the ice forming space 104 in the compartment 66 to displace water during the next fill operation.

Referring now to FIGS. 20-23, an alternative embodiment of an ice tray 2020 and ejector arm 2044 for forming ice cubes having a harvest facilitating shape is shown. Ice tray 2020 and ejector arm 2044 are adapted to be utilized with the icemaker assembly 10 and replace ice tray 20 and ejector arm 44. While there are substantial differences between ice tray 20 and ice tray 2020 and ejector arm 44 and ejector arm 2044, there are sufficient similarities for similar reference numerals to be used in describing similar components with the reference numerals applied to the ice tray 2020 and ejector arm 2044 being 2000 higher than those used with regard to ice tray 20 and ejector arm 44.

Ice tray 2020 is configured to form tapered crescent-shaped ice cubes tapered to the point of forming substantially teardrop-shaped ice cubes 2130. Ice cubes 2130 have a narrow end 2140 and a wide end 2144. Ice tray 2020 is formed so that adjacent ice forming compartments 2066, 2067 are arranged so that the narrow or downstream ends 2106 of the compartments 2066, 2067 are on opposite sides of the ice cube tray 2020. Ice forming compartments 2066 are formed so that their narrow ends 2106 are adjacent the outside 2062 of the tray, while ice forming compartments 2067 are formed so that their narrow ends 2106 are adjacent the inside 2058 of the tray.

Ejector arm 2044 is configured so that adjacent ejector members 2052, 2053 extend from the shaft 2048 of the ejector arm 2044 in opposite directions. The ejector arms 2052, 2053 are arranged along the ejector arm shaft 2048 so that each overlies an associated ice forming compartment 2066, 2067 of the ice tray 2020 when the ice tray 2020 and ejector arm 2044 are mounted to the icemaker assembly 10. In the illustrated embodiment, ejector members 2052 are associated with, and utilized to eject ice cubes 2130 from, the ice forming compartments 2066. Similarly ejector members 2053 are associated with, and utilized to eject ice cubes 2130 from, the ice forming compartments 2067.

Figure 20:
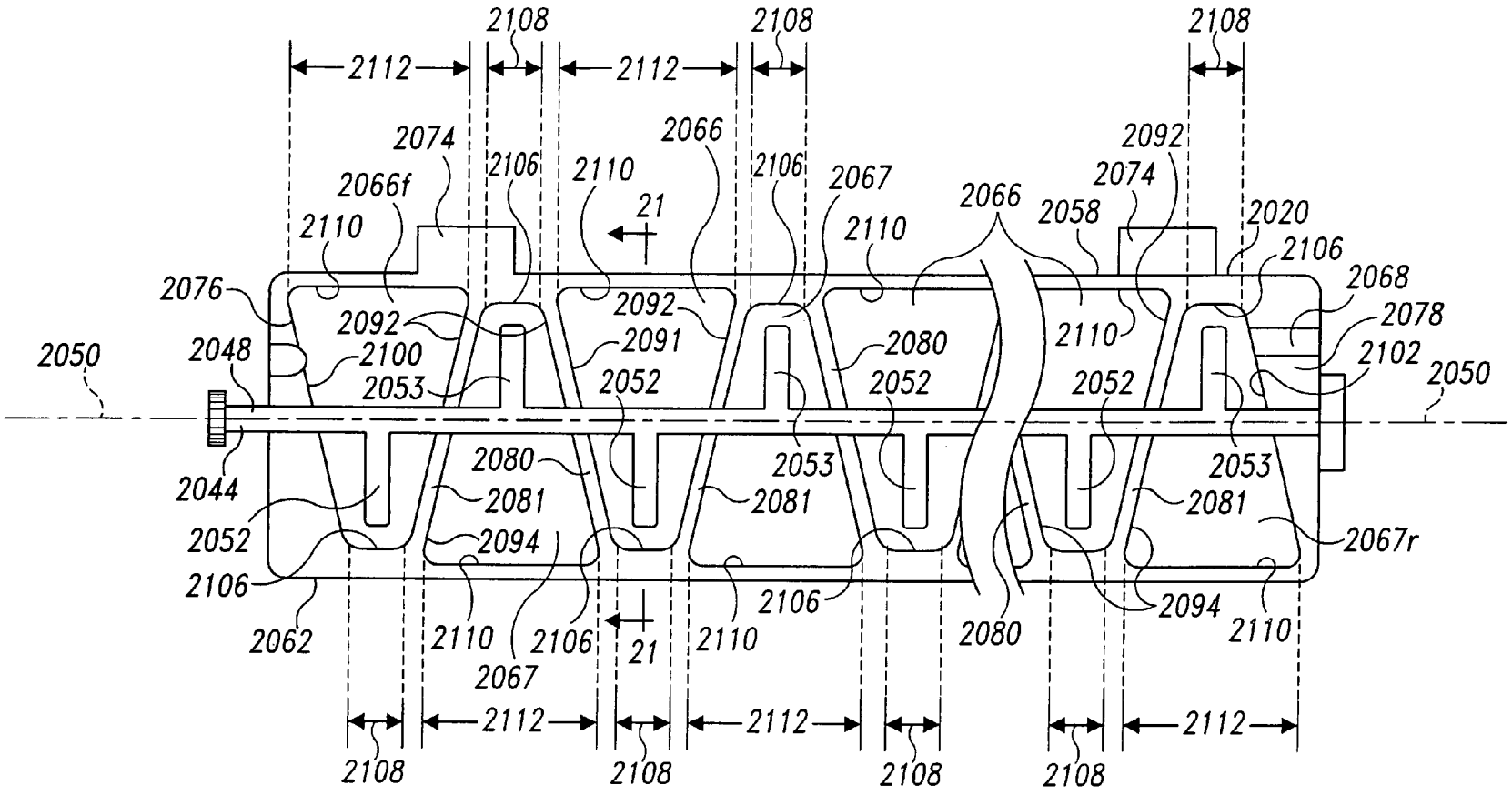
FIG. 20 is a plan view of an alternative ice tray and ejector arm for forming ice cubes that have a harvest facilitating shape showing ice forming compartments oriented in opposite directions.
Figure 21:
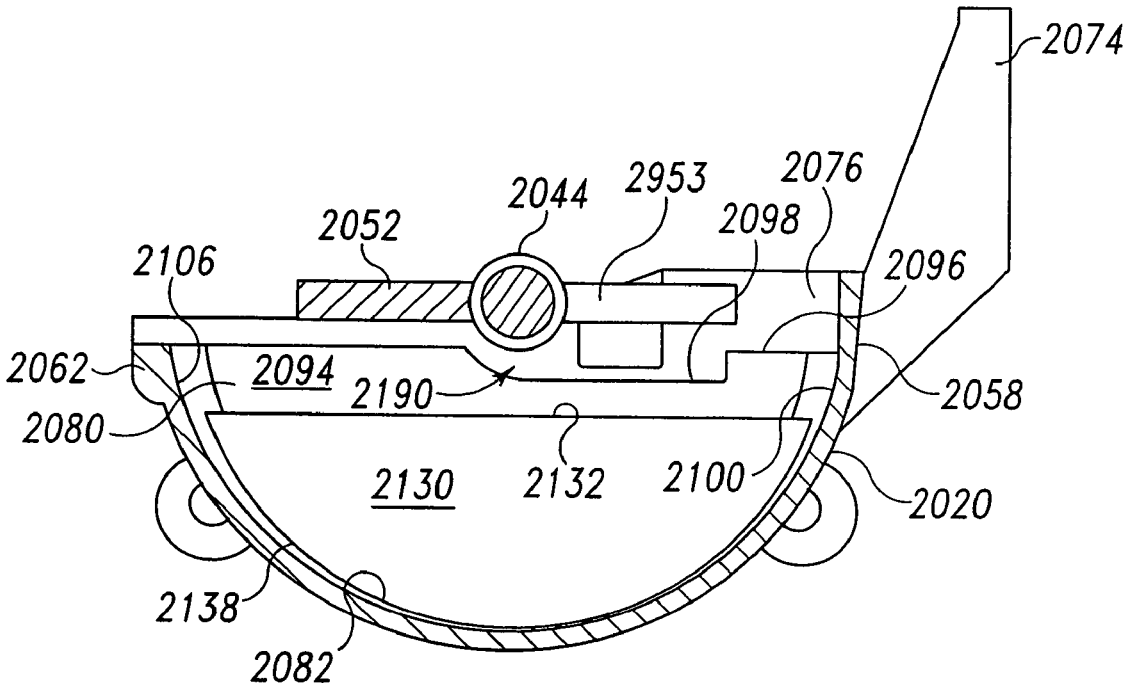
FIG. 21 is a sectional view taken along line 21-21 of the ice tray and ejector arm of FIG. 20.

When the ejector arm 2044 is in a neutral position, as shown, for example, in FIGS. 20 and 21, each ejector member 2052 extends from the shaft 2048 of the ejector arm 2044 toward the outside 2062 of the tray 2020 so that the free end of each ejector arm 2052 is nearest to the narrow end 2106 of its associated ice forming compartment 2066. Similarly, when in the neutral position, each ejector member 2053 extends from the shaft 2048 of the ejector arm 2044 toward the inside 2062 of the tray 2020 so that the free end of each ejector arm 2053 is nearest to the narrow end 2106 of its associated ice forming compartment 2067. In the illustrated embodiment, each ejector member 2052, 2053 is in the form of finger having a length sufficient to extend into its associated ice forming compartment 2066, 2067, respectively, during rotation of the ejector arm 2044.

As shown for example in FIGS. 20-23, ice tray 2020 is formed to include teardrop-shaped compartments 2066, 2067, an end water inlet ramp 2068 and mounting brackets 2074. Tray 2020 includes a first end wall 2076, a second end wall 2078, a plurality of partitions or divider walls 2080, 2081 and a plurality of floor walls 2082 that cooperate to form the ice forming compartments 2066, 2067. In the illustrated embodiment, as shown in FIG. 20, the end water inlet ramp 2068 is formed in the second end wall 2078 to be positioned below the water inlet 28 to facilitate filling the compartments 2066, 2067 using the overflow method.

In the illustrated embodiment, mounting brackets 2074 extend from the inside 2058 of the ice tray 2020 to facilitate mounting the tray 2020 to the mounting side wall 16 of the freezer compartment 12. It is within the scope of the disclosure for other mounting features to be present on the tray 2020 and for those mounting features to facilitate mounting of the tray 2020 to other structures within the freezer compartment 12.

As mentioned above, each partition or divider wall 2080, 2081 extends laterally at an angle relative to longitudinal axis 2050, across the ice tray 2020. In the illustrated embodiment, as divider walls 2080 extend from the outside 2062 toward the inside 2058 they also extend forward. As divider walls 2081 extend from the outside 2062 toward the inside 2058 they also extend rearward.

In the illustrated embodiment, each divider wall 2080, 2081 has a substantially uniform thickness at any given level and includes a forwardly facing lateral side surface 2092, a rearwardly facing lateral side surface 2094 and a top surface 2096. The forwardly facing lateral side surface 2092, rearwardly facing lateral side surface 2094 and top surface 2096 are formed to include an overflow channel 2090. Each overflow channel includes a top wall 2098 positioned below the top surface 2096 of the divider wall 2080, 2081 and is positioned near the desired maximum fill level of each compartment 2066, 2067. The first end wall 2076 includes a rearwardly facing lateral side surface 2100. The second end wall 2078 includes a forwardly facing lateral side surface 2102.

In the illustrated embodiment, water from the water inlet 28 flows down the end water inlet ramp 2068 into the rear ice forming compartment **2067*r*. The water enters and fills the rear ice forming compartment 2067*r* until the level reaches the level of the top wall 2098 of the overflow channel 2090 and then overflows into the compartment 2066 adjacent the rear compartment 2067*r*. After water fills each compartment 2066, 2067 it overflows through the overflow channel 2090** into the adjacent compartment 2067, 2066. When the water in all of the compartments 2066, 2067 has reached a desired level, water flow stops.

Ice tray 2020 seeks to minimize the size of the ice bridge by positioning the overflow channel 2090 very near to the desired maximum fill level. It is within the scope of the disclosure to position the overflow channel 2090 above the maximum fill level to totally eliminate the ice bridge. Because the ejector members 2052, 2053 extend in opposite directions from the shaft 2048 of the ejector arm 2044 utilized with ice tray 2020, water should be displaced from the ice forming compartments 2066, 2067 with displacement members that are distinct from the ejector members 2052, 2053, as envisioned by the incorporated co-pending U.S. patent application Ser. No. 10/895,792, entitled Method and Device for Eliminating Connecting Webs between Ice Cubes. Such distinct displacement members could be formed on the upper side (when in the orientation shown in FIG. 21) of ejector arm 2044 so as to not interfere with ejection of cubes 2130 or could be coupled to a separate displacement member assembly.

As shown, for example, in FIGS. 20-23, the compartments 2066, 2067 in ice tray 2020 are configured to include a space 2104 in which a teardrop-shaped ice cube 2130 is formed. In the illustrated embodiment first end wall 2076 includes a planar lateral side surface 2100 and second end wall 2078 includes a planar lateral side surface 2102. As planar lateral side surface 2102 of second end wall 2078 extends from the outside 2062 toward the inside 2058 it also extends forward. As planar lateral side surface 2100 of first end wall 2076 extends from the outside 2062 toward the inside 2058 it also extends rearward. The forwardly facing planar lateral side surface 2102 of the second end wall 2078, the rearwardly facing planar lateral side surface 2094 of the divider wall 2081 adjacent the second end wall 2078 and the arcuate bottom surface or floor wall 2082 cooperate to define a space 2104 in the rear compartment 2067*r* in which ice is formed. Similarly, the rearwardly facing planar lateral side surface 2100 of the first end wall 2076, the forwardly facing planar lateral side surface 2092 of the divider wall 2080 adjacent the first end wall 2076 and the arcuate bottom surface 2082 cooperate to define a space 2104 in the front compartment 2066*f* in which ice is formed. The spaces 2104 in which ice is formed in the intermediate compartments 2066 are defined by the rearwardly facing planar lateral side surface 2094 of a divider wall 2080, the forwardly facing planar lateral side surface 2092 of the adjacent divider wall 2081 to the rear of the first divider wall 2080 and the arcuate bottom surface 2082. The spaces 2104 in which ice is formed in the intermediate compartments 2067 are defined by the rearwardly facing planar lateral side surface 2094 of a divider wall 2081, the forwardly facing planar lateral side surface 2092 of the adjacent divider wall 2080 to the rear of the first divider wall 2081 and the arcuate bottom surface 2082. Thus the ice forming space 2104 in each compartment 2066, 2067 includes a first planar lateral side surface 2100 or 2094, a second planar lateral side surface 2102 or 2092, and an arcuate bottom surface 2082 interposed between the first lateral side surface 2100 or 2094 and the second lateral side surface 2102 or 2092.

As shown, for example, in FIGS. 20-23, each compartment 2066, 2067 is substantially identical although adjacent compartments are oriented in opposite directions. In each compartment 2066, 2067, one planar lateral side surface 2100, 2094, from an end wall 2076 or a divider wall 2080, 2081, respectively, is positioned relative to a second planar lateral side surface 2092, 2102, from an adjacent divider wall 2081, 2080 or end wall 2078, respectively, so that the first planar lateral side surface 2100, 2094 is spaced apart from the second planar lateral side surface 2092, 2102 at a downstream end 2106 by a distance D1 2108 relative to an ejection path of movement for that compartment 2066.

Figure 22:
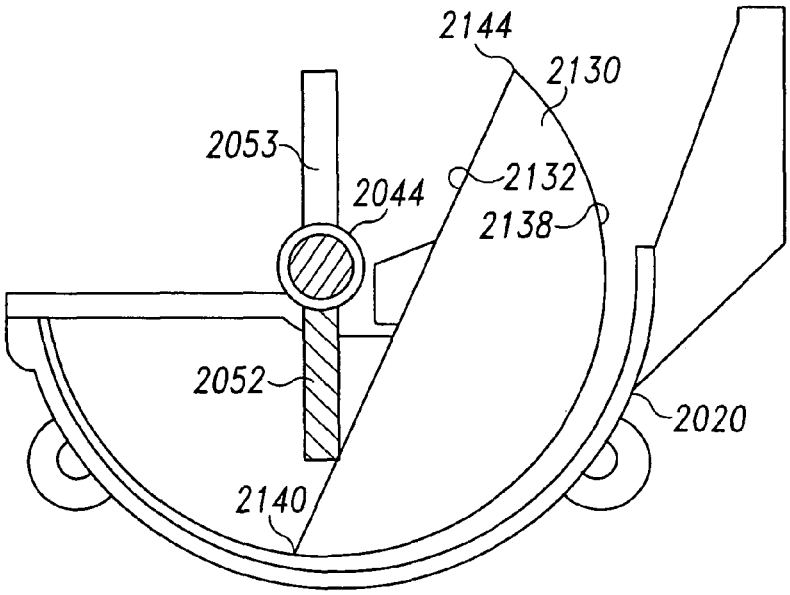
FIG. 22 is a sectional view similar to FIG. 21 showing the ejector arm rotated in a first direction to eject cubes from the ice forming compartments oriented in a first direction of the ice tray.
Figure 23:
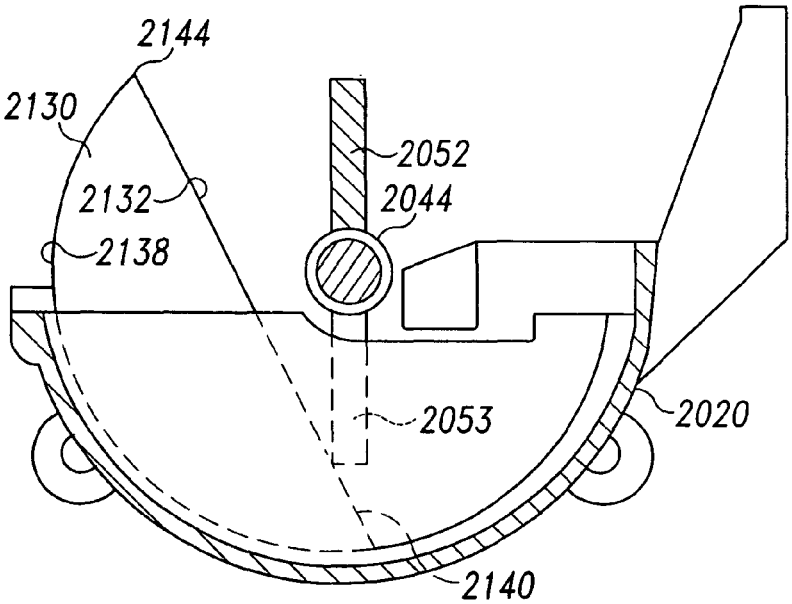
FIG. 23 is a sectional view similar to FIG. 22 showing the ejector arm after it has been rotated in the opposite direction from the first direction of rotation to eject ice cubes formed in the remaining ice forming compartments of the ice tray.

As shown, for example, in FIGS. 20 and 22-23, the ejection path of movement for each adjacent compartment 2066, 2067 is in the opposite direction. In the illustrated embodiment, the ejection path of motion for the front compartment 2066*f*, and each compartment 2066 that also has its narrow end 2106 adjacent the outside 2062 of the tray 2020, is laterally across the ice tray 2020 from the outside 2062 of the ice tray 2020 to the inside 2058 of the ice tray 2020. Thus, as used herein, the downstream end is adjacent the outside 2062 of the tray 2020 with regard to compartments 2066 of the tray 2020. Therefore, adjacent the outside 2062 of the tray, the first planar lateral side wall 2100 of the front compartment 2066*f* and the first planar lateral side wall 2094 of each compartment 2066 rearward therefrom is spaced apart from the second planar lateral side surface 2092 of a divider wall 2081 by the distance D1 2108.

As shown, for example, in FIGS. 20 and 22-23, the ejection path of motion for the rear compartment 2067*r*, and each compartment 2067 that also has its narrow end 2106 adjacent the inside 2058 of the tray 2020, is laterally across the ice tray 2020 from the inside 2058 of the ice tray 2020 to the outside 2062 of the ice tray 2020. Thus, as used herein, the downstream end is adjacent the inside 2058 of the tray 2020 with regard to compartments 2067 of the tray 2020. Therefore, adjacent the inside 2058 of the tray 2020, the first planar lateral side wall 2102 of the rear compartment 2067*r* and the first planar lateral side wall 2092 of each compartment 2067 forward therefrom is spaced apart from the second planar lateral side surface 2094 of a divider wall 2081 by the distance D1 2108.

In each compartment 2066, 2067 the first planar lateral side surface 2100, 2094 is spaced apart from the second planar lateral side surface 2092, 2102 at an upstream or wide end 2110 of the compartment 2066, 2067 by a distance D2 2112 relative to the ejection path of movement. As shown, for example, in FIG. 20, the distance D2 2112 is greater than the distance D1 2108.

In the illustrated embodiment, each lateral side surface 2092, 2094, 2100, 2102 is planar, except for a bottom portion that smoothly curves into the bottom surface 2082 to facilitate formation of the ice tray 2020 using a molding process. As in prior art ice trays, the width of each compartment 2066, 2067 may be narrower near the bottom and wider near the top to facilitate formation of the ice tray 2020 using a molding process. Thus, in describing a distance between lateral side walls 2092, 2094, 2100, 2102 of a compartment 2066, 2067, the distance is measured at the same level within the compartment. As the side surface 2092, 2094, 2100, 2102 extends laterally across the ice tray 2020 from the narrow end 2106 to the wide end 2110 of each compartment 2066, 2067 the distance between each lateral side surface 2100, 2094 and the oppositely facing lateral side surface 2092, 2102 of the compartment 2066, 2067 increases. This increase in distance between oppositely facing lateral side surfaces 2092, 2102 and 2100, 2094, respectively, in each compartment 2066, 2067 is asymptotic.

An ice cube 2130 formed in a space 2104 in an illustrated compartment 2066, 2067 of the ice tray 2020 has an external shape conforming on three surfaces to the lateral side surfaces 2092, 2102 and 2100, 2094, respectively, and bottom surface 2082 of the compartment 2066, 2067. On the top surface 2132, the ice cube 2130 is substantially flat. The top surface 2132 may include an upwardly extending central bulge (not shown) formed as a result of the ice forming process. A method to eliminate this central bulge is described in U.S. patent application Ser. No. 10/895,665, entitled Method and Device for Stirring Water During Icemaking, which is assigned to the same assignee as the present invention, the disclosure of which is hereby incorporated by reference in its entirety.

The ice cube 2130 includes a first lateral side wall and oppositely facing second lateral side wall and an arcuate shaped bottom wall 2138 extending between the first and second lateral side walls, respectively. The ice cube 2130 has a narrow end 2140 having a width substantially equal to the distance D1 2108 and a wide end 2144 having a width substantially equal to the distance D2 2112.

Except where they merge with bottom wall 2138, side walls are substantially planar as a result of the ice conforming to the shape of the lateral side surfaces 2100, 2094 and 2092, 2102 of the compartment 2066, 2067. The distance between lateral side walls at any level of the cube 2130 increases slightly from bottom to top as a result of conforming to the lateral side surfaces 2100, 2094 and 2092, 2102 of the ice forming compartment 2066, 2067 which are configured to facilitate formation of the ice tray 2020 using a molding process. The distance between lateral side walls of the ice cube 2130 increases asymptotically from the narrow end 2140 to the wide end 2144.

Although described and illustrated as being planar, it is within the scope of the disclosure for lateral side surfaces 2100, 2094 and 2092, 2102 of the compartment 2066, 2067 to have other configurations such as being arcuate shaped. However, to avoid having the ice cube 2130 formed in the tray 2020 from having wider sections that must be forced through narrower sections of the compartment 2066, 2067 during ejection, the distance between oppositely facing lateral side surfaces 2100, 2094 and 2092, 2102 should increase from the narrow end 2106 to the wide end 2110 of each compartment 2066, 2067. Preferably, the distance between oppositely facing lateral side surfaces 2100, 2094 and 2092, 2102 of a compartment 2066, 2067 increases asymptotically in relation to the ejection path of movement.

While described and illustrated as having the same configuration, it is within the scope of the disclosure for each compartment 2066, 2067 to have differing configurations. For example, it is within the scope of the disclosure for one compartment 2066, 2067 to include a planar lateral side surface, an oppositely facing arcuate lateral side surface and an arcuate bottom surface while another compartment 2066, 2067 includes two oppositely facing planar lateral side surfaces and a sloped bottom surface. Various combinations of lateral side surface and bottom surfaces may be used to define a compartment 2066, 2067.

Ice tray 2020 is filled using the overflow method described above with water released from the water inlet 28 flowing down the end water inlet ramp 2068 into the rear compartment 2067*r*. When sufficient water has entered the rear compartment 2067*r* to raise the level of the water in the compartment 2067*r* to the level of the top surface 2098 of the overflow channel 2090, water overflows into the adjacent compartment 2066 until the adjacent compartment 2066 overflows into its adjacent compartment 2067. This fill and overflow process continues until water has filled each compartment 2066, 2067.

At some time prior to the water freezing in each compartment 2066, 2067, the ejector arm 2044 is positioned as shown in FIG. 21 so that each ejection member 2052, 2053 is disposed entirely outside of the ice forming space 2104 in its associated compartment 2066, 2067, respectively.

Preferably each cube 2130 is formed separately within its own compartment 2066, 2067 with no ice bridge or web extending between cubes 2130 by displacing water from each compartment during the filling process. However, the ice tray 2020 is formed to reduce the thickness of the ice bridge or web even if water is not displaced during filling. The size of the ice cube 2130 formed in each compartment 2066, 2067 can be varied by varying the volume of the portion of the displacement member disposed in the ice forming space 2104 during the filling operation. This method of filling an ice cube tray is more particularly described in co-pending U.S. patent application Ser. No. 10/895,792, entitled Method and Device for Eliminating Connecting Webs between Ice Cubes.

In the illustrated embodiment, once an ice cube 2130 has formed in each compartment 2066, 2067, the controller 30 may actuate a heater 54, if one is provided, to heat the tray 2020 to expand the same and possibly melt a small amount of ice cube 2130 adjacent the walls of each compartment 2066, 2067. The melting of a portion of the cube 2130 provides a lubrication layer between the ice cube 2130 and the walls of the compartment 2066, 2067. The lubrication layer and the expansion reduce the torque which the ejector arm 2044 must exert on the ice cube 2130 to induce the cube 2130 to move along the ejection path of movement and be ejected from the ice tray 2020. The innovative design of the walls of the compartments 2066, 2067 of the ice tray 2020 further reduces the torque required for the ejector arm 2044 to eject the ice cubes 2130 from the ice tray 2020. Additionally, since the ejector arm 2044 acts to eject only about half of the ice cubes 2130 (either those in compartments 2066 or those in compartments 2067) at a time, the torque exerted on the ejector arm 2044 is further minimized. Thus, the temperature rise required in the heating step may be reduced or even eliminated.

The innovative design of the compartments 2066, 2067 of the ice cube tray 2020 facilitates shorter heating cycles or even the elimination of the heating cycle. This may reduce the power consumption of the heater or even allow the elimination of the heater. Any reduction in the heating cycle also increases the efficiency of the freezer compartment 12 as less heat is required to be dissipated following each ice cube ejection cycle. Additionally, since wider sections of an ice cube 2130 are not forced through narrower sections of a compartment 2066, 2067 the ice cube 2130 is less likely to chip than a conventional ice cube 180 during ejection. The reduction or elimination of chips, in combination with the reduction in the heating cycle, makes it less likely that ice cubes 2130 will fuse together in the ice bin 24.

Once the ice cubes 2130 are ready for ejection, the controller 30 actuates the motor 42 to turn its output shaft which is coupled through the drive train 46 to the ejector shaft 2048. The motor 42 drives the ejector shaft 2048 to rotate about the rotation axis 2091 in the direction of arrow 2056 (FIG. 22) inducing the front face 2118 of each ejection member 2052 into contact with the ice cube 2130 formed in its associated compartment 2066. The front face 2118 of each ejector member 2052 contacts the top surface 2132 of its associated ice cube 2130 adjacent the narrow end 2140 of the cube 2130 and exerts a force driving the narrow end 2140 of the cube 2130 downwardly along the arcuate bottom surface 2082 of the compartment 2066, as shown, for example, in FIG. 22.

As the narrow end 2140 of the ice cube 2130 is driven downwardly along the arcuate bottom surface 2082 of the compartment 2066, the rigidity of the ice cube 2130, the bottom wall 2138 of the ice cube 2130 and the arcuate bottom surface 2082 of the compartment 2066 cooperate to urge the wide end 2144 of the ice cube 2130 to move upwardly along the bottom surface 2082 of the compartment 2066 on the inside 2058 of the tray 2020. As the ejector arm 2044 continues to rotate in the direction of arrow 2056, the front surface 2118 of the ejector member 2052 follows the ejection path of movement laterally through the compartment 2066 inducing more and more of the ice cube 2130 to be ejected from the compartment 2066 on the inside 2058.

As the narrow end 2140 of the ice cube 2130 approaches the inside 2058 of the tray 2020, the wider end 2144 begins to move laterally toward the outside 2062 of the tray 2020. Eventually, the ice cube 2130 falls outwardly and downwardly into the ice bin 24 located below the ice tray 2020. The ice cubes 2130 in compartments 2066 are ejected from those compartments 2066 by ejector members 2052 long before the ejector members 2053 are rotated sufficiently to engage the wide end 2110 of the ice cubes 2130 in compartments 2067. Thus, rotation of the ejector arm 2044 in the direction of arrow 2056 is stopped before the ejector members 2053 engage the ice cubes 2130 in compartments 2067. The direction of rotation of the ejector arm 2044 is then reversed to induce rotation of the ejector arm 44 in the direction of arrow 2057 (FIG. 23).

Following ejection of ice cubes 2130 from compartments 2066, the motor 42 drives the ejector shaft 2048 to rotate about the rotation axis 91 in the direction of arrow 2057 inducing the front face 2118 of each ejection member 2053 into contact with the ice cube 2130 formed in its associated compartment 2067. The front face 2118 of each ejector member 2053 contacts the top surface 2132 of its associated ice cube 2130 adjacent the narrow end 2140 of the cube 2130 and exerts a force driving the narrow end 2140 of the cube 2130 downwardly along the arcuate bottom surface 2082 of the compartment 2067.

As the narrow end 2140 of the ice cube 2130 is driven downwardly along the arcuate bottom surface 2082 of the compartment 2067, the rigidity of the ice cube 2130, the bottom wall 2138 of the ice cube 2130 and the arcuate bottom surface 2082 of the compartment 2067 cooperate to urge the wide end 2144 of the ice cube 2130 to move upwardly along the bottom surface 2082 of the compartment 2067 on the outside 2062 of the tray 2020, as shown, for example, in FIG. 23. As the ejector arm 2044 continues to rotate in the direction of arrow 2057, the front surface 2118 of the ejector member 2053 follows the ejection path of movement laterally through the compartment 2067 inducing more and more of the ice cube 2130 to be ejected from the compartment 2067 on the outside 2062. Eventually, the ice cube 2130 falls outwardly and downwardly into the ice bin 24 located below the ice tray 20. Once the ejector arm 2044 has proceeded along the ejection path of movement a sufficient distance to completely eject the ice cubes 2130 from each compartment 2067, the ejector arm 2044 is positioned for the next fill cycle.

Since the distance between the lateral side walls 2100, 2094 and 2092, 2102 of the compartments 2066, 2067 increases relative to the ejection path of movement, thinner portions of the ice cubes 2130 are forced through wider portions of the compartments 2066, 2067 during ejection. Since narrower side walls of the ice cubes 2130 are passing through wider walls 2100, 2094 and 2092, 2102 of the compartments 2066, 2067, friction between the ice cubes 2130 and the lateral walls 2100, 94 and 92, 102 of the compartments 2066, 2067 is substantially reduced or eliminated. The reduction of friction between the side walls of the ice cubes 2130 and the lateral walls 2100, 2094 and 2092, 2102 of the compartment 2066, 2067, and the fact that only about half of the ice cubes 2130 are being ejected at any one time, results in less torque being exerted on the motor 42 and drive train 46 than would be required during ejection of a prior ice cube 180 from a prior art tray. Thus, a less robust motor 40, drive train 46 and ejector arm 44 may be utilized to eject the ice cubes 2130 from the disclosed tray 2020.

While the icemaker assembly 10 is disclosed with reference to the illustrated refrigerator/freezer 14 having a through-the-door ice dispenser, it is within the scope of the disclosure for the invention to be utilized in an icemaker assembly 10 without an automatic ice dispenser. Such icemakers typically include a bin 24 having a top opening large enough to receive ice cubes 130, 2130 ejected from the icemaker tray 20 and also allowing access to ice cubes 130, 2130 in the bin 24 by the dwelling occupant.

Although specific embodiments of the invention have been described herein, other embodiments may be perceived by those skilled in the art without departing from the scope of the invention as defined by the following claims.

What is claimed is:

1. An icemaker assembly, comprising:

an ice tray having at least one ice forming compartment that defines a space;

an ice ejector having at least one ejector member; and a motor having an output shaft coupled to said ice ejector, wherein rotation of said output shaft causes said at least one ejector member to advance into said space whereby ice located in said space is urged in an ejection path of movement out of said at least one ice forming compartment, wherein said at least one ice forming compartment includes (i) a first planar lateral side surface, (ii) a second planar lateral side surface, and (iii) an arcuate bottom surface interposed between said first lateral side surface and said second lateral side surface, and wherein said first planar lateral side surface and said second planar lateral side surface are positioned relative to each other so that (i) said first planar lateral side surface is spaced apart from said second planar lateral side surface at a downstream end of said at least one ice forming compartment by a distance D1 relative to said ejection path of movement, (ii) said first planar lateral side surface is spaced apart from said second planar lateral side surface at an upstream end of said at least one ice forming compartment by a distance D2 relative to said ejection path of movement, and (iii) D2 is greater than D1.

2. The icemaker assembly of claim 1, wherein:

said icemaker assembly has a plurality of ice forming compartments that includes said at least one ice forming compartment and additional ice forming compartments, and said additional ice forming compartments each possesses the same physical configuration as said at least one ice forming compartment.

3. The icemaker assembly of claim 2, wherein said plurality of ice forming compartments includes seven ice forming compartments.

4. The icemaker assembly of claim 1, wherein:

said ice tray includes a first partition member and a second partition member, said space is interposed between said first partition member and a second partition member.

5. The icemaker assembly of claim 4, wherein:

said first partition member defines said first planar lateral side surface, said second partition member defines said second planar lateral side surface, and said space is interposed between said first planar lateral side surface and said second planar lateral side surface.

6. The icemaker assembly of claim 1, wherein:

said ice tray includes a partition member and an end wall, said space is interposed between said partition member and said end wall.

7. The icemaker assembly of claim 6, wherein:

said end wall has a bearing surface defined therein, and a shaft of said ice ejector is positioned in contact with said bearing surface.

8. The icemaker assembly of claim 6, wherein:

said partition member defines said first planar lateral side surface, said end wall defines said second planar lateral side surface, and said space is interposed between said first planar lateral side surface and said second planar lateral side surface.

9. The icemaker assembly of claim 1, wherein:

said ice ejector further includes a shaft, and said at least one ejector member is secured to said shaft.

10. An icemaker assembly, comprising:

an ice tray having at least one ice forming compartment that defines a space; and an ice ejector having at least one ejector member configured to be received in said at least one ice forming compartment and to advance into said space to enable ice located in said space to be urged in an ejection path of movement out of said at least one ice forming compartment, wherein said at least one ice forming compartment is defined by (i) a first partition member, (ii) a second partition member, and (iii) a floor, wherein said space is (i) interposed between said first partition member and said second partition member, and (ii) positioned above said floor, and wherein said first partition member and said second partition member are positioned relative to each other so that (i) said first partition member is spaced apart from said second partition member at a downstream end of said at least one ice forming compartment by a distance D1 relative to said ejection path of movement, (ii) said first partition member is spaced apart from said second partition member at an upstream end of said at least one ice forming compartment by a distance D2 relative to said ejection path of movement, and (iii) D2 is greater than D1.

11. The icemaker assembly of claim 10, wherein said first partition member defines a first planar lateral side surface, said second partition member defines a second planar lateral side surface, and said space is interposed between said first planar lateral side surface and said second planar lateral side surface.

12. The icemaker assembly of claim 10, wherein:

said ice ejector further includes a shaft, and said at least one ejector member is secured to said shaft.

13. The icemaker assembly of claim 12, wherein:

said ice tray includes an end wall that has a bearing surface defined therein, and said shaft of said ice ejector is positioned in contact with said bearing surface.

14. The icemaker assembly of claim 10, wherein:

said icemaker assembly has a plurality of ice forming compartments that includes said at least one ice forming compartment and additional ice forming compartments, and said additional ice forming compartments each possesses the same physical configuration as said at least one ice forming compartment.

15. The icemaker assembly of claim 14, wherein said plurality of ice forming compartments includes seven ice forming compartments.

16. The icemaker assembly of claim 10, wherein said ice ejector further has (i) a central shaft to which said at least one ejector member is secured, and (ii) a motor having an output shaft coupled to said ejector shaft.

* * * * *